US008206516B2

(12) United States Patent
Yoshimura et al.

(10) Patent No.: US 8,206,516 B2
(45) Date of Patent: Jun. 26, 2012

(54) R—FE—B RARE EARTH SINTERED MAGNET AND METHOD FOR PRODUCING SAME

(75) Inventors: Koshi Yoshimura, Osaka (JP); Hideyuki Morimoto, Osaka (JP); Tomoori Odaka, Osaka (JP)

(73) Assignee: Hitachi Metals, Ltd., Tokyo (JP)

( * ) Notice: Subject to any disclaimer, the term of this patent is extended or adjusted under 35 U.S.C. 154(b) by 383 days.

(21) Appl. No.: 12/092,286

(22) PCT Filed: Mar. 1, 2007

(86) PCT No.: PCT/JP2007/053892

§ 371 (c)(1),
(2), (4) Date: May 1, 2008

(87) PCT Pub. No.: WO2007/102391

PCT Pub. Date: Sep. 13, 2007

(65) Prior Publication Data

US 2008/0286595 A1 Nov. 20, 2008

(30) Foreign Application Priority Data

| | | |
|---|---|---|
| Mar. 3, 2006 | (JP) | 2006-058555 |
| Jul. 27, 2006 | (JP) | 2006-204847 |
| Jul. 27, 2006 | (JP) | 2006-204848 |
| Sep. 4, 2006 | (JP) | 2006-239198 |
| Dec. 28, 2006 | (JP) | 2006-355280 |

(51) Int. Cl.
*H01F 1/057* (2006.01)

(52) U.S. Cl. ..... 148/122; 148/101; 148/302

(58) Field of Classification Search ..... None
See application file for complete search history.

(56) References Cited

U.S. PATENT DOCUMENTS

| | | | | |
|---|---|---|---|---|
| 2006/0213585 | A1* | 9/2006 | Nakamura et al. | 148/302 |
| 2006/0278517 | A1 | 12/2006 | Machida et al. | |
| 2007/0034299 | A1 | 2/2007 | Machida et al. | |
| 2008/0245442 | A1* | 10/2008 | Nakamura et al. | 148/101 |
| 2008/0257716 | A1* | 10/2008 | Nagata et al. | 204/192.12 |
| 2009/0020193 | A1* | 1/2009 | Ohta et al. | 148/559 |

FOREIGN PATENT DOCUMENTS

| | | | |
|---|---|---|---|
| EP | 0 251 871 | A2 | 1/1988 |
| EP | 0 994 493 | A2 | 4/2000 |
| EP | 1 643 513 | A1 | 4/2006 |

(Continued)

OTHER PUBLICATIONS

ASM Handbook (Formerly Ninth Edition, Metals Handbook) vol. 15, Casting, p. 410-419, 1988.*

(Continued)

*Primary Examiner* — John Sheehan
(74) *Attorney, Agent, or Firm* — Keating & Bennett, LLP

(57) ABSTRACT

In a method for producing an R—Fe—B based rare-earth sintered magnet according to the present invention, first, provided is an R—Fe—B based rare-earth sintered magnet body including, as a main phase, crystal grains of an $R_2Fe_{14}B$ type compound that includes a light rare-earth element RL, which is at least one of Nd and Pr, as a major rare-earth element R. Thereafter, the sintered magnet body is heated while a heavy rare-earth element RH, which is at least one element selected from the group consisting of Dy, Ho and Tb, is supplied to the surface of the sintered magnet body, thereby diffusing the heavy rare-earth element RH into the rare-earth sintered magnet body.

11 Claims, 21 Drawing Sheets

FOREIGN PATENT DOCUMENTS

| | | | |
|---|---|---|---|
| JP | 62-192566 | A | 8/1987 |
| JP | 1-117303 | A | 5/1989 |
| JP | 04-120238 | A | 4/1992 |
| JP | 2004-296973 | A | 10/2004 |
| JP | 2004-304038 | A | 10/2004 |
| JP | 2005-11973 | A | 1/2005 |
| JP | 2005-175138 | A | 6/2005 |
| JP | 2005-285859 | A | 10/2005 |
| WO | 2006/100968 | A1 | 9/2006 |

OTHER PUBLICATIONS

The Condensed Chemical Dictionary, Eight Edition, 1971, pp. 376-377.*

Official Communication issued in corresponding European Patent Application No. 07715105.8, mailed on Jan. 27, 2010.

Official communication issued in the International Application No. PCT/JP2007/053892, mailed on May 29, 2007.

Official communication issued in counterpart Japanese Application No. 2008-290899, mailed on Mar. 3, 2009.

Tarasov et al.: "The Influence of an Additive Chemical Composition and Its Phase State on Magnetic Properties of Nd—Fe—B Type Permanent Magnets," Proceedings of the 15th International Workshop on Rare-Earth Magnets and their Applications; Aug. 30, 1998; vol. 1; pp. 447-451.

Official communication issued in counterpart International Application No. PCT/JP2007/053892, mailed on Sep. 18, 2008.

Official communication issued in counterpart Japanese Application No. 2008-503806, mailed on Sep. 16, 2008.

Nishiuchi et al.; "R-13 Fe—B Porous Magnet and Method for Producing the Same"; U.S. Appl. No. 12/092,300, filed May 1, 2008.

Nozawa et al.; "R—Fe—B Microcrystalline High-Density Magnet and Process for Production Thereof"; U.S. Appl. No. 12/254,967, filed Oct. 21, 2008.

* cited by examiner

°C
1000~1200
800~950
TEMPERATURE
Pa
1~10^5
1×10^-5~1
PRESSURE
TEMPER-
ATURE
PRESSURE
SINTERING
PROCESS B
(B″1)
(B″2)
(B″3)
DIFFUSION
PROCESS C
(A)
TIME (a) (b) (c) (d)

(a) (b) (c) (d)

(a)

(b)

(a)

(b)

(a)

(b)

(a)

(b)

(a)

(b)

(a)

(b)

(a)

(b)

(a)

(b)

R—FE—B RARE EARTH SINTERED MAGNET AND METHOD FOR PRODUCING SAME

TECHNICAL FIELD

The present invention relates to an R—Fe—B based rare-earth sintered magnet including crystal grains of an $R_2Fe_{14}B$ type compound (where R is a rare-earth element) as a main phase and a method for producing such a magnet. More particularly, the present invention relates to an R—Fe—B based rare-earth sintered magnet, which includes a light rare-earth element RL (which is at least one of Nd and Pr) as a major rare-earth element R and in which a portion of the light rare-earth element RL is replaced with a heavy rare-earth element RH (which is at least one element selected from the group consisting of Dy, Ho and Tb) and a method for producing such a magnet.

BACKGROUND ART

An R—Fe—B based rare-earth sintered magnet, including an $Nd_2Fe_{14}B$ type compound phase as a main phase, is known as a permanent magnet with the highest performance, and has been used in various types of motors such as a voice coil motor (VCM) for a hard disk drive and a motor for a hybrid car and in numerous types of consumer electronic appliances. When used in motors and various other devices, the R—Fe—B based rare-earth sintered magnet should exhibit thermal resistance and coercivity that are high enough to withstand an operating environment at an elevated temperature.

As a means for increasing the coercivity of an R—Fe—B based rare-earth sintered magnet, a molten alloy, including a heavy rare-earth element RH as an additional element, may be used. According to this method, the light rare-earth element RL, which is included as a rare-earth element R in an $R_2Fe_{14}B$ phase, is replaced with a heavy rare-earth element RH, and therefore, the magnetocrystalline anisotropy (which is a physical quantity that determines the coercivity) of the $R_2Fe_{14}B$ phase improves. However, although the magnetic moment of the light rare-earth element RL in the $R_2Fe_{14}B$ phase has the same direction as that of Fe, the magnetic moments of the heavy rare-earth element RH and Fe have mutually opposite directions. That is why the greater the percentage of the light rare-earth element RL replaced with the heavy rare-earth element RH, the lower the remanence $B_r$ would be.

Meanwhile, as the heavy rare-earth element RH is one of rare natural resources, its use is preferably cut down as much as possible. For these reasons, the method in which the light rare-earth element RL is entirely replaced with the heavy rare-earth element RH is not preferred.

To get the coercivity increased effectively with the addition of a relatively small amount of the heavy rare-earth element RH, it was proposed that an alloy or compound powder, including a lot of the heavy rare-earth element RH, be added to a main phase material alloy powder including a lot of the light rare-earth element RL and then the mixture be compacted and sintered. According to this method, the heavy rare-earth element RH is distributed a lot in the vicinity of the grain boundary of the $R_2Fe_{14}B$ phase, and therefore, the magnetocrystalline anisotropy of the $R_2Fe_{14}B$ phase can be improved efficiently on the outer periphery of the main phase. The R—Fe—B based rare-earth sintered magnet has a nucleation-type coercivity generating mechanism. That is why if a lot of the heavy rare-earth element RH is distributed on the outer periphery of the main phase (i.e., near the grain boundary thereof), the magnetocrystalline anisotropy of all crystal grains is improved, the nucleation of reverse magnetic domains can be interfered with, and the coercivity increases as a result. At the core of the crystal grains that does not contribute to increasing the coercivity, no light rare-earth element RL is replaced with the heavy rare-earth element RH. Consequently, the decrease in remanence $B_r$ can be minimized there, too.

If this method is actually adopted, however, the heavy rare-earth element RH has an increased diffusion rate during the sintering process (which is carried out at a temperature of 1,000° C. to 1,200° C. on an industrial scale) and could diffuse to reach the core of the crystal grains, too. For that reason, it is not easy to obtain the expected crystal structure.

As another method for increasing the coercivity of an R—Fe—B based rare-earth sintered magnet, a metal, an alloy or a compound including a heavy rare-earth element RH is deposited on the surface of the sintered magnet and then thermally treated and diffused. Then, the coercivity could be recovered or increased without decreasing the remanence so much (see Patent Documents Nos. 1, 2 and 3).

Patent Document No. 1 teaches forming a thin-film alloy layer, including 1.0 at % to 50.0 at % of at least one element that is selected from the group consisting of Ti, W, Pt, Au, Cr, Ni, Cu, Co, Al, Ta and Ag and R' as the balance (which is at least one element selected from the group consisting of Ce, La, Nd, Pr, Dy, Ho and Tb), on the surface of a sintered magnet body to be machined.

Patent Document No. 2 discloses that a metallic element R (which is at least one rare-earth element selected from the group consisting of Y, Nd, Dy, Pr, Ho and Tb) is diffused to a depth that is at least equal to the radius of crystal grains exposed on the uppermost surface of a small-sized magnet, thereby repairing the damage done on the machined surface and increasing (BH) max.

Patent Document No. 3 discloses that the magnetic properties could be recovered by depositing a CVD film, consisting mostly of a rare-earth element, on the surface of a magnet with a thickness of 2 mm or less.

Patent Document No. 4 discloses a method of sorbing a rare-earth element to recover the coercivity of a very small R—Fe—B based sintered magnet or its powder. According to the method of Patent Document No. 4, a sorption metal, which is a rare-earth metal such as Yb, Eu or Sm with a relatively low boiling point, and a very small R—Fe—B based sintered magnet or its powder are mixed together, and then the mixture is subjected to a heat treatment to heat it uniformly in a vacuum while stirring it up. As a result of this heat treatment, the rare-earth metal is not only deposited on the surface of the magnet but also diffused inward. Patent Document No. 4 also discloses an embodiment in which a rare-earth metal with a high boiling point such as Dy is sorbed. In such an embodiment that uses Dy, for example, Dy is selectively heated to a high temperature by an induction heating process. However, Dy has a boiling point of 2,560° C. According to Patent Document No. 4, Yb with a boiling point of 1,193° C. should be heated to a temperature of 800° C. to 850° C. but could not be heated sufficiently by a normal resistance heating process. Considering this disclosure of Patent Document No. 4, it is presumed that the Dy be heated to a temperature exceeding 1,000° C. to say the least. Patent Document No. 4 also discloses that the temperature of the very small R—Fe—B based sintered magnet and its powder is preferably maintained within the range of 700° C. to 850° C.

Patent Document No. 1: Japanese Patent Application Laid-Open Publication No. 62-192566

Patent Document No. 2: Japanese Patent Application Laid-Open Publication No. 2004-304038

Patent Document No. 3: Japanese Patent Application Laid-Open Publication No. 2005-285859

Patent Document No. 4: Japanese Patent Application Laid-Open Publication No. 2004-296973

DISCLOSURE OF INVENTION

Problems to be Solved by the Invention

All of the techniques disclosed in Patent Documents Nos. 1, 2 and 3 were developed to repair the damage done on the machined surface of a sintered magnet. That is why the metallic element, diffused inward from the surface, can reach no farther than a surface region of the sintered magnet. For that reason, if the magnet had a thickness of 3 mm or more, the coercivity could hardly be increased effectively.

Meanwhile, according to the conventional technique disclosed in Patent Document No. 4, a rare-earth metal such as Dy is heated to, and deposited at, a temperature that is high enough to vaporize it easily. That is why the deposition rate is far higher than the diffusion rate in the magnet, and a thick Dy film is deposited on the surface of the magnet. As a result, in the surface region of the magnet (with a depth of several tens of μm as measured from the surface), a big difference in Dy concentration at the interface between the Dy film deposited and the sintered magnet body should inevitably generate a driving force to diffuse Dy into the main phase as well. Consequently, the remanence $B_r$ drops.

On top of that, according to the method of Patent Document No. 4, the rare-earth metal is also deposited a lot on unexpected portions of the deposition system (e.g., on the inner walls of the vacuum chamber) other than the magnet during the deposition process, which is against the policy of saving a heavy rare-earth element that is one of rare and valuable natural resources.

Furthermore, according to the embodiment that uses a rare-earth metal with a low boiling point such as Yb, the coercivity of each very small R—Fe—B based sintered magnet can be recovered to a certain degree. But it is difficult to prevent the sorption metal from melting and sticking to the R—Fe—B based magnet during the heat treatment process for diffusion or to separate them from each other after the heat treatment process. That is to say, it is virtually inevitable that unreacted sorption metal (RH) remains on the surface of the sintered magnet, which would decrease the percentage of magnetic components in the magnet compact (i.e., deteriorate the magnetic properties thereof). In addition, since a rare-earth metal is very active and easily oxidizable by nature, that unreacted sorption metal should often start corrosion in practical use, which is not beneficial. Besides, since the mixture needs to be rotated to be stirred up and subjected to the heat treatment in a vacuum at the same time, a special type of equipment that can maintain a predetermined thermal resistance and a prescribed pressure (or airtightness) and also includes a rotation mechanism would be required. That is why the initial equipment cost, product quality and stability of production would all be problems to realize mass production. What is more, if a powder were used as the material of the sorption metal, some safety precautions should be taken so as not to fire the powder or do any harm on human bodies and it would take a lot of trouble and increased cost to prepare the powder in the first place.

Furthermore, according to the embodiment that uses a rare-earth metal with a high boiling point such as Dy, the sorption material and the magnet are both heated by an induction heating process. That is why it is not easy to heat only the rare-earth metal to a sufficiently high temperature and yet maintain it at a temperature that is low enough to avoid affecting the magnetic properties. As a result, the magnet will often have a powder state or a very small size and is not easily subjected to the induction heating process in either case.

In order to overcome the problems described above, the present invention has an object of providing an R—Fe—B based rare-earth sintered magnet, in which a small amount of heavy rare-earth element RH is used efficiently and has been diffused on the outer periphery of crystal grains of the main phase everywhere in the magnet, even if the magnet is relatively thick.

Means for Solving the Problems

A method for producing an R—Fe—B based rare-earth sintered magnet according to the present invention includes the steps of: (a) providing an R—Fe—B based rare-earth sintered magnet body including, as a main phase, crystal grains of an $R_2Fe_{14}B$ type compound that includes a light rare-earth element RL, which is at least one of Nd and Pr, as a major rare-earth element R; (b) arranging a bulk body including a heavy rare-earth element RH, which is at least one element selected from the group consisting of Dy, Ho and Tb, along with the R—Fe—B based rare-earth sintered magnet body in a processing chamber; and (c) heating the bulk body and the R—Fe—B based rare-earth sintered magnet body to a temperature of 700° C. to 1,000° C., thereby diffusing the heavy rare-earth element RH into the R—Fe—B based rare-earth sintered magnet body while supplying the heavy rare-earth element RH from the bulk body to the surface of the R—Fe—B based rare-earth sintered magnet body.

In one preferred embodiment, the step (c) includes arranging the bulk body and the R—Fe—B based rare-earth sintered magnet body out of contact with each other in the processing chamber and setting an average gap between the two bodies within the range of 0.1 mm to 300 mm.

In another preferred embodiment, the step (c) includes setting a difference in temperature between the R—Fe—B based rare-earth sintered magnet body and the bulk body within 20° C.

In still another preferred embodiment, the step (c) includes adjusting the pressure of an atmospheric gas in the processing chamber within the range of $10^{-5}$ Pa to 500 Pa.

In yet another preferred embodiment, the step (c) includes maintaining the temperatures of the bulk body and the R—Fe—B based rare-earth sintered magnet body within the range of 700° C. to 1,000° C. for 10 minutes to 600 minutes.

In yet another preferred embodiment, the sintered magnet body includes 0.1 mass % to 5.0 mass % of a heavy rare-earth element RH, which is at least one element selected from the group consisting of Dy, Ho and Tb.

In this particular preferred embodiment, the content of the heavy rare-earth element RH in the sintered magnet body is within the range of 1.5 mass % to 3.5 mass %.

In yet another preferred embodiment, the bulk body includes an alloy of the heavy rare-earth element RH and an element X, which is at least one element selected from the group consisting of Nd, Pr, La, Ce, Al, Zn, Sn, Cu, Co, Fe, Ag and In.

In a specific preferred embodiment, the element X is at least one of Nd and Pr.

In yet another preferred embodiment, the method further includes the step of subjecting the R—Fe—B based rare-earth sintered magnet body to an additional heat treatment process after the step (c) has been performed.

Another method for producing an R—Fe—B based rare-earth sintered magnet according to the present invention includes the steps of: (A) arranging a compact of an R—Fe—B based rare-earth magnet powder, including a light rare-earth element RL (which is at least one of Nd and Pr) as a major rare-earth element R, in a processing chamber such that the compact faces a bulk body including a heavy rare-earth element RH, which is at least one element selected from the group consisting of Dy, Ho and Tb; (B) performing a sintering process in the processing chamber, thereby making an R—Fe—B based rare-earth sintered magnet body including crystal grains of an $R_2Fe_{14}B$ type compound as a main phase; and (C) heating the bulk body and the R—Fe—B based rare-earth sintered magnet body in the processing chamber, thereby diffusing the heavy rare-earth element RH into the R—Fe—B based rare-earth sintered magnet body while supplying the heavy rare-earth element RH from the bulk body to the surface of the R—Fe—B based rare-earth sintered magnet body.

In one preferred embodiment, the step (B) includes performing the sintering process for 30 minutes to 600 minutes with a vacuum of 1 Pa to 1 Pa created in the processing chamber and with an atmosphere in the processing chamber maintained at a temperature of 1,000° C. to 1,200° C.

In another preferred embodiment, the step (C) includes performing the heating process for 10 minutes to 600 minutes with a vacuum of $1\times10^{-5}$ Pa to 1 Pa created in the processing chamber and with an atmosphere in the processing chamber maintained at a temperature of 800° C. to 950° C.

In still another preferred embodiment, the method further includes the step (B') of adjusting the degree of vacuum in the processing chamber within the range of $1\times10^{-5}$ Pa to 1 Pa after the temperature of the atmosphere in the processing chamber has decreased to 950° C. or less and after the step (B) has been performed.

In yet another preferred embodiment, the method further includes the step (B") of performing a heat treatment process for 30 minutes to 300 minutes with the degree of vacuum in the processing chamber adjusted within the range of $1\times10^{-5}$ Pa to 1 Pa and the temperature of the atmosphere in the processing chamber controlled within the range of 1,000° C. to 1,200° C. and then lowering the temperature in the processing chamber to 950° C. or less after the step (B) has been performed.

An R—Fe—B based rare-earth sintered magnet according to the present invention is produced by a method according to any of the preferred embodiments of the present invention described above and includes, as a main phase, crystal grains of an $R_2Fe_{14}B$ type compound that includes a light rare-earth element RL (which is at least one of Nd and Pr) as a major rare-earth element R. The magnet further includes a heavy rare-earth element RH (which is at least one element selected from the group consisting of Dy, Ho and Tb and) which has been introduced from its surface by grain boundary diffusion. In a surface region of the magnet, which is defined from the surface to a depth of 100 μm, there is a difference of at least 1 at % between the concentration of the heavy rare-earth element RH at a center portion of the crystal grains of the $R_2Fe_{14}B$ type compound and that of the heavy rare-earth element RH on a grain boundary phase of the crystal grains of the $R_2Fe_{14}B$ type compound.

Effects of the Invention

According to the present invention, by producing a grain boundary diffusion of a heavy rare-earth element RH (which is at least one element selected from the group consisting of Dy, Ho and Tb), the heavy rare-earth element RH can be supplied deeper into a sintered magnet body, and the light rare-earth element RL can be efficiently replaced with the heavy rare-earth element RH on the outer periphery of the main phase. As a result, the coercivity $H_{cJ}$ can be increased with a decrease in remanence $B_r$ minimized.

Figure 1:
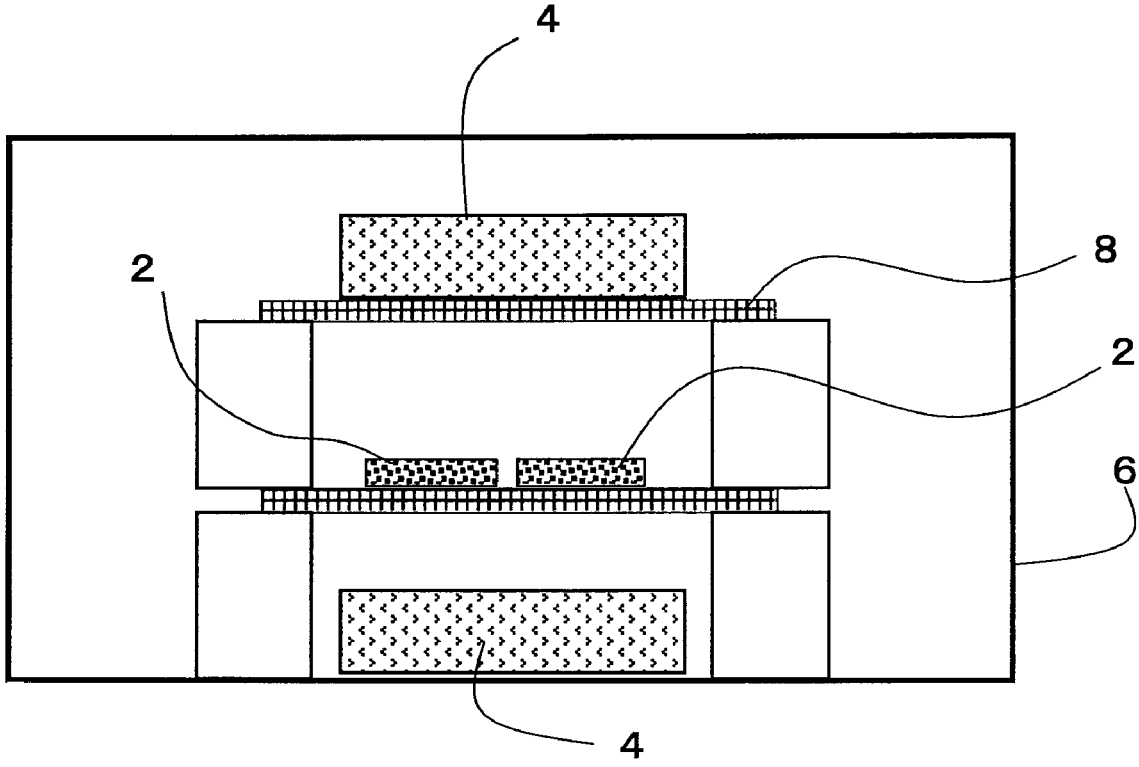
FIG. 1 is a cross-sectional view schematically illustrating the configuration of a process vessel that can be used effectively in a process for producing an R—Fe—B based rare-earth sintered magnet according to the present invention and an exemplary arrangement of RH bulk bodies and sintered magnet bodies in the process vessel.

| DESCRIPTION OF REFERENCE NUMERALS | |
|---|---|
| 2 | sintered magnet body |
| 4 | RH bulk body |
| 6 | processing chamber |
| 8 | Nb net |

BEST MODE FOR CARRYING OUT THE INVENTION

An R—Fe—B based rare-earth sintered magnet according to the present invention includes a heavy rare-earth element RH that has been introduced into a sintered body through its surface by a grain boundary diffusion process. In this case, the heavy rare-earth element RH is at least one element selected from the group consisting of Dy, Ho and Tb.

The R—Fe—B based rare-earth sintered magnet of the present invention is produced preferably by supplying the heavy rare-earth element RH from a heavy rare-earth bulk body (which will be referred to herein as an "RH bulk body") to the surface of a sintered magnet body and diffusing the heavy rare-earth element RH deeper into the sintered body from the surface thereof.

In the manufacturing process of the present invention, a bulk body of a heavy rare-earth element RH that is not easily vaporizable (or sublimable) and a rare-earth sintered magnet body are heated to a temperature of 700° C. to 1,000° C., thereby reducing the vaporization (or sublimation) of the RH bulk body to the point that the growth rate of an RH film is not excessively higher than the rate of diffusion of RH into the magnet and diffusing the heavy rare-earth element RH, which has traveled to reach the surface of the sintered magnet body, into the magnet body quickly. At such a temperature falling within the range of 700° C. to 1,000° C., the heavy rare-earth element RH hardly vaporizes (or sublimes) but diffuses actively in an R—Fe—B based rare-earth sintered magnet. For that reason, the grain boundary diffusion of the heavy rare-earth element RH into the magnet body can be accelerated preferentially than the film formation of the heavy rare-earth element RH on the surface of the magnet body.

It should be noted that to diffuse a heavy rare-earth element RH into a sintered magnet body from the surface thereof while supplying the heavy rare-earth element RH from a heavy rare-earth bulk body (which will be referred to herein as an "RH bulk body") to the surface of a sintered magnet body will be sometimes simply referred to herein as "evaporation diffusion". According to the present invention, the heavy rare-earth element RH will diffuse and penetrate into the magnet at a higher rate than the heavy rare-earth element RH diffusing into the main phase that is located near the surface of the sintered magnet.

In the prior art, it has been believed that to vaporize (or sublime) a heavy rare-earth element RH such as Dy, the magnet body should be heated to a temperature exceeding 1,000° C. and that it would be impossible to deposit Dy on the magnet body just by heating it to a temperature as low as 700° C. to 1,000° C. Contrary to this popular belief, however, the results of experiments the present inventors carried out revealed that the heavy rare-earth element RH could still be supplied onto an opposing rare-earth magnet and diffused into it even at such a low temperature of 700° C. to 1,000° C.

According to the conventional technique of forming a film of a heavy rare-earth element RH (which will be referred to herein as an "RH film") on the surface of a sintered magnet body and then diffusing the element into the sintered magnet body by a heat treatment process, so-called "intragrain diffusion" will advance significantly in the surface region that is in contact with the RH film, thus deteriorating the properties of the magnet. On the other hand, according to the present invention, since the heavy rare-earth element RH is supplied onto the surface of the sintered magnet body with the growth rate of the RH film decreased and the temperature of the sintered magnet body is maintained at an appropriate level for diffusion, the heavy rare-earth element RH that has reached the surface of the magnet body quickly penetrates into the sintered magnet body by a grain boundary diffusion process. That is why even in the surface region, the "grain boundary diffusion" advances more preferentially than the "intragrain diffusion". As a result, the decrease in remanence $B_r$ can be minimized and the coercivity $H_{cJ}$ can be increased effectively.

The R—Fe—B based rare-earth sintered magnet has a nucleation type coercivity generating mechanism. Therefore, if the magnetocrystalline anisotropy is increased on the outer periphery of a main phase, the nucleation of reverse magnetic domains can be reduced in the vicinity of the grain boundary phase surrounding the main phase. As a result, the coercivity $H_{cJ}$ of the main phase can be increased effectively as a whole. According to the present invention, the heavy rare-earth replacement layer can be formed on the outer periphery of the main phase not only in a surface region of the sintered magnet body but also deep inside the magnet. Consequently, the magnetocrystalline anisotropy can be increased in the entire magnet and the coercivity $H_{cJ}$ of the overall magnet increases sufficiently. Therefore, according to the present invention, even if the amount of the heavy rare-earth element RH consumed is small, the heavy rare-earth element RH can still diffuse and penetrate deep inside the sintered body. And by forming a layer including the heavy rare-earth element RH at a high concentration efficiently on the outer periphery of the main phase, the coercivity $H_{cJ}$ can be increased with the decrease in remanence $B_r$ minimized.

Considering the facility of evaporation diffusion, the cost and other factors, it is most preferable to use Dy as the heavy rare-earth element RH that replaces the light rare-earth element RL on the outer periphery of the main phase. However, the magnetocrystalline anisotropy of $Tb_2Fe_{14}B$ is higher than that of $Dy_2Fe_{14}B$ and is about three times as high as that of $Nd_2Fe_{14}B$. That is why if Tb is evaporated and diffused, the coercivity can be increased most efficiently without decreasing the remanence of the sintered magnet body. When Tb is used, the evaporation diffusion is preferably carried out at a higher temperature and in a higher vacuum than a situation where Dy is used.

As can be seen easily from the foregoing description, according to the present invention, the heavy rare-earth element RH does not always have to be added to the material alloy. That is to say, a known R—Fe—B based rare-earth sintered magnet, including a light rare-earth element RL (which is at least one of Nd and Pr) as the rare-earth element R, may be provided and the heavy rare-earth element RH may be diffused inward from the surface of the magnet. If only the conventional heavy rare-earth layer were formed on the surface of the magnet, it would be difficult to diffuse the heavy rare-earth element RH deep inside the magnet even at an elevated diffusion temperature. However, according to the present invention, by producing the grain boundary diffusion of the heavy rare-earth element RH, the heavy rare-earth element RH can be supplied efficiently to even the outer periphery of the main phase that is located deep inside the sintered magnet body. The present invention is naturally applicable to an R—Fe—B based sintered magnet, to which the heavy rare-earth element RH was already added when it was a material alloy. However, if a lot of heavy rare-earth element RH were added to the material alloy, the effect of the present invention would not be achieved sufficiently. For that reason, a relatively small amount of heavy rare-earth element RH may be added in that early stage.

Next, an example of a preferred diffusion process according to the present invention will be described with reference to FIG. 1, which illustrates an exemplary arrangement of sintered magnet bodies 2 and RH bulk bodies 4. In the example illustrated in FIG. 1, the sintered magnet bodies 2 and the RH bulk bodies 4 are arranged so as to face each other with a predetermined gap left between them inside a processing chamber 6 made of a refractory metal. The processing chamber 6 shown in FIG. 1 includes a member for holding a plurality of sintered magnet bodies 2 and a member for holding the RH bulk body 4. Specifically, in the example shown in FIG. 1, the sintered magnet bodies 2 and the upper RH bulk body 4 are held on a net 8 made of Nb. However, the sintered magnet bodies 2 and the RH bulk bodies 4 do not have to be held in this way but may also be held using any other member. Nevertheless, a member that closes the gap between the sintered magnet bodies 2 and the RH bulk bodies 4 should not be used. As used herein, "facing" means that the sintered magnet bodies and the RH bulk bodies are opposed to each other without having their gap closed. Also, even if two members are arranged "so as to face each other", it does not necessarily means that those two members are arranged such that their principal surfaces are parallel to each other.

By heating the processing chamber 6 with a heater (not shown), the temperature of the processing chamber 6 is raised. In this case, the temperature of the processing chamber 6 is controlled to the range of 700° C. to 1,000° C., more preferably to the range of 850° C. to 950° C. In such a temperature range, the heavy rare-earth element RH has a very low vapor pressure and hardly vaporizes. In the prior art, it has been commonly believed that in such a temperature range, a heavy rare-earth element RH, vaporized from an RH bulk body 4, be unable to be supplied and deposited on the surface of the sintered magnet body 2.

However, the present inventors discovered that by arranging the sintered magnet body 2 and the RH bulk body 4 close to each other, not in contact with each other, a heavy rare-earth metal could be deposited at as low a rate as several μm per hour (e.g., in the range of 0.5 μm/hr to 5 μm/hr) on the surface of the sintered magnet body 2. We also discovered that by controlling the temperature of the sintered magnet body 2 within an appropriate range such that the temperature of the sintered magnet body 2 was equal to or higher than that of the RH bulk body 4, the heavy rare-earth element RH that had been deposited in vapor phase could be diffused deep into the sintered magnet body 2 as it was. This temperature range is a preferred one in which the RH metal diffuses inward through the grain boundary phase of the sintered magnet body 2. As a result, slow deposition of the RH metal and quick diffusion thereof into the magnet body can be done efficiently.

According to the present invention, RH that has vaporized just slightly as described above is deposited at a low rate on the surface of the sintered magnet body. For that reason, there is no need to heat the processing chamber to a high temperature that exceeds 1,000° C. or apply a voltage to the sintered magnet body or RH bulk body as in the conventional process of depositing RH by a vapor phase deposition process.

Also, according to the present invention, with the vaporization and sublimation of the RH bulk body minimized, the heavy rare-earth element RH that has arrived at the surface of the sintered magnet body is quickly diffused inside the magnet body. For that purpose, the RH bulk body and the sintered magnet body preferably both have a temperature falling within the range of 700° C. to 1,000° C.

The gap between the sintered magnet body 2 and the RH bulk body 4 is set to fall within the range of 0.1 mm to 300 mm. This gap is preferably 1 mm to 50 mm, more preferably 20 mm or less, and even more preferably 10 mm or less. As long as such a distance can be kept between them, the sintered magnet bodies 2 and the RH bulk bodies 4 may be arranged either vertically or horizontally or may even be moved relative to each other. Nevertheless, the distance between the sintered magnet bodies 2 and the RH bulk bodies 4 preferably remains the same during the evaporation diffusion process. Also, an embodiment in which the sintered magnet bodies are contained in a rotating barrel and processed while be stirred up is not preferred. Furthermore, since the vaporized RH can create a uniform RH atmosphere within the distance range defined above, the area of their opposing surfaces is not particularly limited but even their narrowest surfaces may face each other. The present inventors discovered and confirmed via experiments that when the RH bulk bodies were arranged perpendicularly to the magnetization direction (i.e., the c-axis direction) of the sintered magnet bodies 2, RH could diffuse into the sintered magnet bodies 2 most efficiently. This is probably because when RH diffuses inward through the grain boundary phase of the sintered magnet bodies 2, the diffusion rate in the magnetization direction is higher than that in the perpendicular direction. That difference in diffusion rate between the magnetization and perpendicular directions should be caused by a difference in anisotropy due to the crystal structure.

In a conventional evaporation system, a good distance should be kept between an evaporating material supply section and the target being processed because a mechanism surrounding the evaporating material supply section would make interference and should be exposed to an electron beam or an ion beam. For that reason, the evaporating material supply section (corresponding to the RH bulk body 4) and the target being processed (corresponding to the sintered magnet body 2) have never been arranged so close to each other as in the present invention. As a result, it has been believed that unless the evaporating material is heated to a rather high temperature and vaporized sufficiently, plenty of the evaporating material could not be supplied onto the target being processed.

In contrast, according to the present invention, the RH metal can be deposited on the surface of the magnet just by controlling the temperature of the overall processing chamber without using any special mechanism for vaporizing (or subliming) the evaporating material. As used herein, the "processing chamber" broadly refers to a space in which the sintered magnet bodies 2 and the RH bulk bodies 4 are arranged. Thus, the processing chamber may mean the processing chamber of a heat treatment furnace but may also mean a processing container housed in such a processing chamber.

Also, according to the present invention, the RH metal vaporizes little but the sintered magnet body and the RH bulk body are arranged close to each other but not in contact with each other. That is why the RH metal vaporized can be deposited on the surface of the sintered magnet body efficiently and is hardly deposited on the wall surfaces of the processing chamber. Furthermore, if the wall surfaces of the processing chamber are made of a heat-resistant alloy including Nb, for example, a ceramic, or any other material that does not react to RH, then the RH metal deposited on the wall surfaces will vaporize again and will be deposited on the surface of the sintered magnet body after all. As a result, it is possible to avoid an unwanted situation where the heavy rare-earth element RH, which is one of valuable natural resources, is wasted in vain.

Within the processing temperature range of the diffusion process to be carried out according to the present invention, the RH bulk body never melts or softens but the RH metal vaporizes (sublimes) from its surface. For that reason, the RH bulk body does not change its appearance significantly after having gone through the process step just once, and therefore, can be used repeatedly a number of times.

Besides, as the RH bulk bodies and the sintered magnet bodies are arranged close to each other, the number of sintered magnet bodies that can be loaded into a processing chamber with the same capacity can be increased. That is to say, high loadability is realized. In addition, since no bulky system is required, a normal vacuum heat treatment furnace may be used and the increase in manufacturing cost can be avoided, which is very beneficial in practical use.

During the heat treatment process, an inert atmosphere is preferably maintained inside the processing chamber. As used herein, the "inert atmosphere" refers to a vacuum or an atmosphere filled with an inert gas. Also, the "inert gas" may be a rare gas such as argon (Ar) gas but may also be any other gas as long as the gas is not chemically reactive between the RH bulk body and the sintered magnet body. The pressure of the inert gas is reduced so as to be lower than the atmospheric pressure. If the pressure of the atmosphere inside the processing chamber were close to the atmospheric pressure, then the RH metal would not be supplied easily from the RH bulk body to the surface of the sintered magnet body. However, since the amount of the RH metal diffused is determined by the rate of diffusion from the surface of the magnet toward the inner portion thereof, it should be enough to lower the pressure of the atmosphere inside the processing chamber to $10^2$ Pa or less, for example. That is to say, even if the pressure of the atmosphere inside the processing chamber were further lowered, the amount of the RH metal diffused (and eventually the degree of increase in coercivity) would not change significantly. The amount of the RH metal diffused is sensitive to the temperature of the sintered magnet body, rather than the pressure.

The RH metal that has traveled to reach the surface of the sintered magnet body and then be deposited there starts to diffuse toward the inside of the magnet through the grain boundary phase under the driving forces generated by the heat of the atmosphere and the difference in RH concentration at the interface of the magnet. In the meantime, a portion of the light rare-earth element RL in the $R_2Fe_{14}B$ phase is replaced with the heavy rare-earth element RH that has diffused and penetrated from the surface of the magnet. As a result, a layer including the heavy rare-earth element RH at a high concentration is formed on the outer periphery of the $R_2Fe_{14}B$ phase.

By forming such a layer including RH at a high concentration, the magnetocrystalline anisotropy can be improved and the coercivity $H_{cJ}$ can be increase on the outer periphery of the main phase. That is to say, even by using a small amount of RH metal, the heavy rare-earth element RH can diffuse and penetrate deeper into the magnet and the layer including RH at a high concentration can be formed on the outer periphery of the main phase efficiently. As a result, the coercivity $H_{cJ}$ of the overall magnet can be increased with the decrease in remanence $B_r$ minimized.

In the prior art, the rate of deposition of a heavy rare-earth element RH such as Dy on the surface of a sintered magnet body (i.e., a film growth rate) is much higher than the rate of diffusion of the heavy rare-earth element RH toward the inside of the sintered magnet body (i.e., a diffusion rate). That is why an RH film is deposited to a thickness of several μm or more on the surface of the sintered magnet body and then the heavy rare-earth element RH is diffused from that RH film toward the inside of the sintered magnet body. However, the heavy rare-earth element RH that has been supplied from the RH film in solid phase, not in vapor phase, not only diffuses through the grain boundary but also makes an intragrain diffusion inside the main phase that is located in the surface region of the sintered magnet body, thus causing a decrease in remanence $B_r$. That region in which the heavy rare-earth element RH makes such an intragrain diffusion inside the main phase to make the RH concentrations no different between the main and grain boundary phases is limited to the surface region of the sintered magnet body (with a thickness of 100 μm or less, for example). If the overall magnet is thin, however, some decrease in remanence $B_r$ is inevitable.

On the other hand, according to the present invention, the heavy rare-earth element RH such as Dy that has been supplied in vapor phase impinges on the surface of the sintered magnet body and then quickly diffuses toward the inside of the sintered magnet body. This means that before diffusing and entering the main phase that is located in the surface region, the heavy rare-earth element RH will diffuse through the grain boundary phase at a higher rate and penetrate deeper into the sintered magnet body.

According to the present invention, in the surface region up to a depth of 100 μm as measured from the surface of the sintered magnet body, there is a difference of at least 1 at % between the concentration of the heavy rare-earth element RH at the center of crystal grains of an $R_2Fe_{14}B$ type compound and that of the heavy rare-earth element RH on the grain boundary phase of the crystal grains of the $R_2Fe_{14}B$ type compound. To minimize the decrease in remanence $B_r$, a concentration difference of at least 2 at % is preferably created.

The content of the RH to diffuse is preferably within the range of 0.05 wt % to 1.5 wt % of the overall magnet. This content range is preferred because the decrease in remanence $B_r$ could be out of control at an RH content of more than 1.5 wt % but because the increase in coercivity $H_{cJ}$ would not be significant at an RH content of less than 0.1 wt %. By conducting a heat treatment process for 10 to 180 minutes within the temperature range and the pressure range defined above, an amount of diffusion of 0.1 wt % to 1 wt % is realized. The process time means a period of time in which the RH bulk body and the sintered magnet body have temperatures of 700° C. to 1,000° C. and pressures of $10^{-5}$ Pa to 500 Pa. Thus, during this process time, their temperatures and pressures are not always kept constant.

The surface state of the sintered magnet is as close to a metal state as possible to allow RH to diffuse and penetrate easily. For that purpose, the sintered magnet is preferably subjected to an activation treatment such as acid cleaning or blast cleaning in advance. According to the present invention, however, when the heavy rare-earth element RH vaporizes and gets deposited in an active state on the surface of the sintered magnet body, the heavy rare-earth element RH will diffuse toward the inside of the sintered magnet body at a higher rate than the deposition rate of a solid layer. That is why the surface of the sintered magnet body may also have been oxidized to a certain degree as is observed right after a sintering process or a cutting process.

According to the present invention, the heavy rare-earth element RH can be diffused mainly through the grain boundary phase. For that reason, the heavy rare-earth element RH can be diffused deeper into the magnet more efficiently by controlling the process time.

In addition, the vaporization rate of the heavy rare-earth element RH can also be controlled by adjusting the pressure of the processing atmosphere. That is why the RH bulk bodies may be arranged in the system before the sintering process is started and the sintering reaction may be advanced at a relatively high atmospheric gas pressure during the sintering process with the vaporization of RH minimized. In that case, after the sintering process is over, the atmospheric gas pressure may be decreased to advance the vaporization and diffusion of RH at the same time. In this manner, the sintering process and the coercivity increasing process can be carried out continuously using the same equipment. Such a method will be described in detail later for a second preferred embodiment of the present invention.

The shape and size of the RH bulk bodies are not particularly limited. For example, the RH bulk bodies may have a plate shape or an indefinite shape (e.g., a stone shape). Optionally, the RH bulk bodies may have a lot of very small holes with diameters of several tens of μm. The RH bulk bodies are preferably made of either an RH metal including at least one heavy rare-earth element RH or an alloy including RH. Also, the higher the vapor pressure of the material of the RH bulk bodies, the greater the amount of RH that can be introduced per unit time and the more efficient. Oxides, fluorides and nitrides including a heavy rare-earth element RH have so low vapor pressures that evaporation diffusion hardly occurs under the conditions falling within these ranges of temperatures and degrees of vacuum. For that reason, even if the RH bulk bodies are made of an oxide, a fluoride or a nitride including the heavy rare-earth element RH, the coercivity cannot be increased effectively.

According to the present invention, even if the given magnet has a thickness of 3 mm or more, the remanence $B_r$ and coercivity $H_{cJ}$ of the magnet can be both increased using just a small amount of heavy rare-earth element RH, thus providing a high performance magnet, of which the magnetic properties do not deteriorate even at high temperatures. Such a high performance magnet contributes immensely to realizing an ultrasmall high output motor. The effect of the present invention utilizing the grain boundary diffusion can be achieved significantly on a magnet with a thickness of 10 mm or less.

According to the present invention, the heavy rare-earth element RH may diffuse and penetrate either from the entire surface of the sintered magnet body or from just a part of the surface. To make RH diffuse and penetrate from just a part of the surface of the sintered magnet body, the sintered magnet body may be thermally treated just as described above with the other portion of the sintered magnet body, in which the diffusion and penetration should not occur, masked, for example. According to such a method, a magnet with partially increased coercivity $H_{cJ}$ can be obtained.

If the magnet that has gone through the evaporation diffusion process of the present invention is subjected to an additional heat treatment process, the coercivity $H_{cJ}$ can be further increased. The conditions of the additional heat treatment process, including the processing temperature and the process time, may be the same as those for the evaporation diffusion process. That is to say, the magnet is preferably maintained at a temperature of 700° C. to 1,000° C. for 10 to 600 minutes.

The additional heat treatment process may be carried out just by thermally treating the magnet with the partial pressure of Ar increased to about $10^3$ Pa after the diffusion process such that the heavy rare-earth element RH does not vaporize. Alternatively, after the diffusion process has been finished once, only the heat treatment may be carried out under the same conditions as the diffusion process without putting the RH evaporation source.

By subjecting the sintered magnet body to the evaporation diffusion process, the transverse rupture strength and other mechanical strength of the sintered magnet body can be increased, which is beneficial in practical use. This is presumably because the degree of matching between the crystal grains of the main phase and those of the grain boundary phase has increased as a result of the removal of the internal strain from the sintered magnet body, the repair of damage on the machined layer, or the diffusion of the heavy rare-earth element RH during the evaporation and diffusion process. If the degree of matching increases between the crystal grains of the main phase and those of the grain boundary phase, the grain boundary can be consolidated and the resistance to rupture of the grain boundary can be increased.

Hereinafter, a preferred embodiment of a method for producing an R—Fe—B based rare-earth sintered magnet according to the present invention will be described.

Embodiment 1

Material Alloy

First, an alloy including 25 mass % to 40 mass % of a light rare-earth element RL, 0.6 mass % to 1.6 mass % of B (boron) and Fe and inevitably contained impurities as the balance is provided. A portion of B may be replaced with C (carbon) and a portion (50 at % or less) of Fe may be replaced with another transition metal element such as Co or Ni. For various purposes, this alloy may contain about 0.01 mass % to about 1.0 mass % of at least one additive element M that is selected from the group consisting of Al, Si, Ti, V, Cr, Mn, Ni, Cu, Zn, Ga, Zr, Nb, Mo, Ag, In, Sn, Hf, Ta, W, Pb and Bi.

Such an alloy is preferably made by quenching a melt of a material alloy by a strip casting process, for example. Hereinafter, a method of making a rapidly solidified alloy by a strip casting process will be described.

First, a material alloy with the composition described above is melted by an induction heating process within an argon atmosphere to make a melt of the material alloy. Next, this melt is kept heated at about 1,350° C. and then quenched by a single roller process, thereby obtaining a flake-like alloy block with a thickness of about 0.3 mm. Then, the alloy block thus obtained is pulverized into flakes with a size of 1 mm to 10 mm before being subjected to the next hydrogen pulverization process. Such a method of making a material alloy by a strip casting process is disclosed in U.S. Pat. No. 5,383,978, for example.

Coarse Pulverization Process

Next, the material alloy block that has been coarsely pulverized into flakes is loaded into a hydrogen furnace and then subjected to a hydrogen decrepitation process (which will be sometimes referred to herein as a "hydrogen pulverization process") within the hydrogen furnace. When the hydrogen pulverization process is over, the coarsely pulverized alloy powder is preferably unloaded from the hydrogen furnace in an inert atmosphere so as not to be exposed to the air. This should prevent the coarsely pulverized powder from being oxidized or generating heat and would eventually improve the magnetic properties of the resultant magnet.

As a result of this hydrogen pulverization process, the rare-earth alloy is pulverized to sizes of about 0.1 mm to several millimeters with a mean particle size of 500 μm or less. After the hydrogen pulverization, the decrepitated material alloy is preferably further crushed to finer sizes and cooled. If the material alloy unloaded still has a relatively high temperature, then the alloy should be cooled for a longer time.

Fine Pulverization Process

Next, the coarsely pulverized powder is finely pulverized with a jet mill pulverizing machine. A cyclone classifier is connected to the jet mill pulverizing machine for use in this preferred embodiment. The jet mill pulverizing machine is fed with the rare-earth alloy that has been coarsely pulverized in the coarse pulverization process (i.e., the coarsely pulverized powder) and gets the powder further pulverized by its pulverizer. The powder, which has been pulverized by the pulverizer, is then collected in a collecting tank by way of the cyclone classifier. In this manner, a finely pulverized powder with sizes of about 0.1 μm to about 20 μm (typically 3 μm to 5 μm) can be obtained. The pulverizing machine for use in such a fine pulverization process does not have to be a jet mill but may also be an attritor or a ball mill. Optionally, a lubricant such as zinc stearate may be added as an aid for the pulverization process.

Press Compaction Process

In this preferred embodiment, 0.3 wt % of lubricant is added to, and mixed with, the magnetic powder, obtained by the method described above, in a rocking mixer, thereby coating the surface of the alloy powder particles with the lubricant. Next, the magnetic powder prepared by the method described above is compacted under an aligning magnetic field using a known press machine. The aligning magnetic field to be applied may have a strength of 1.5 to 1.7 tesla (T), for example. Also, the compacting pressure is set such that the green compact has a green density of about 4 g/cm$^3$ to about 4.5 g/cm$^3$.

Sintering Process

The powder compact described above is preferably sequentially subjected to the process of maintaining the compact at a temperature of 650° C. to 1,000° C. for 10 to 240 minutes and then to the process of further sintering the compact at a higher temperature (of 1,000° C. to 1,200° C., for example) than in the maintaining process. Particularly when a liquid phase is produced during the sintering process (i.e., when the temperature is in the range of 650° C. to 1,000° C.), the R-rich phase on the grain boundary phase starts to melt to produce the liquid phase. Thereafter, the sintering process advances to form a sintered magnet eventually. The sintered magnet body can also be subjected to the evaporation diffusion process even if its surface has been oxidized as described above. For that reason, the sintered magnet body may be subjected to an aging treatment (at a temperature of 400° C. to 700° C.) or machined to adjust its size.

Evaporation Diffusion Process

Next, the heavy rare-earth element RH is made to diffuse and penetrate efficiently into the sintered magnet body thus obtained, thereby increasing the coercivity $H_{cJ}$ thereof. More specifically, an RH bulk body, including the heavy rare-earth element RH, and a sintered magnet body are put into the processing chamber shown in FIG. 1 and then heated, thereby diffusing the heavy rare-earth element RH into the sintered magnet body while supplying the heavy rare-earth element RH from the RH bulk body onto the surface of the sintered magnet body.

In the diffusion process of this preferred embodiment, the temperature of the sintered magnet body is preferably set equal to or higher than that of the bulk body. As used herein, when the temperature of the sintered magnet body is equal to or higher than that of the bulk body, it means that the difference in temperature between the sintered magnet body and the bulk body is within 20° C. Specifically, the temperatures of the RH bulk body and the sintered magnet body preferably both fall within the range of 700° C. to 1,000° C. Also, the gap between the sintered magnet body and the RH bulk body should be within the range of 0.1 mm to 300 mm, preferably 3 mm to 100 mm, and more preferably 4 mm to 50 mm, as described above.

Also, the pressure of the atmospheric gas during the evaporation diffusion process preferably falls within the range of $10^{-5}$ Pa to 500 Pa. Then, the evaporation diffusion process can be carried out smoothly with the vaporization (sublimation) of the RH bulk body advanced appropriately. To carry out the evaporation diffusion process efficiently, the pressure of the atmospheric gas preferably falls within the range of $10^{-3}$ Pa to 1 Pa. Furthermore, the amount of time for maintaining the temperatures of the RH bulk body and the sintered magnet body within the range of 700° C. to 1,000° C. is preferably 10 to 600 minutes. It should be noted that the "time for maintaining the temperatures" refers to a period in which the RH bulk body and the sintered magnet body have temperatures varying within the range of 700° C. to 1,000° C. and pressures varying within the range of $10^{-5}$ Pa to 500 Pa and does not necessarily refer to a period in which the RH bulk body and sintered magnet body have their temperatures and pressures fixed at a particular temperature and a particular pressure.

The diffusion process of this preferred embodiment is not sensitive to the surface status of the sintered magnet body, and therefore, a film of Al, Zn or Sn may be deposited on the surface of the sintered magnet body before the diffusion process. This is because Al, Zn and Sn are low-melting metals and because a small amount of Al, Zn or Sn would not deteriorate the magnetic properties or would not interfere with the diffusion, either. It should be noted that the bulk body does not have to be made of a single element but may include an alloy of a heavy rare-earth element RH and an element X, which is at least one element selected from the group consisting of Nd, Pr, La, Ce, Al, Zn, Sn, Cu, Co, Fe, Ag and In. Such an element X would lower the melting point of the grain boundary phase and would hopefully promote the grain boundary diffusion of the heavy rare-earth element RH. By thermally treating, in a vacuum, the bulk body of such an alloy and an Nd sintered magnet that are spaced from each other, the heavy rare-earth element RH and the element X can be not only evaporated and deposited on the surface of the magnet but also diffused into the magnet through the grain boundary phase (Nd-rich phase) that has turned into a liquid phase preferentially.

Also, during the heat treatment for diffusion, very small amounts of Nd and Pr vaporize from the grain boundary phase. That is why the element X is preferably Nd and/or Pr because in that case, the element X would compensate for the Nd and/or Pr that has vaporized.

Optionally, after the diffusion process is over, the additional heat treatment process described above may be carried out at a temperature of 700° C. to 1,000° C. If necessary, an aging treatment is also carried out at a temperature of 400° C. to 700° C. If the additional heat treatment at a temperature of 700° C. to 1,000° C. is carried out, the aging treatment is preferably performed after the additional heat treatment has ended. The additional heat treatment and the aging treatment may be conducted in the same processing chamber.

In practice, the sintered magnet body that has been subjected to the evaporation diffusion process is preferably subjected to some surface treatment, which may be a known one such as Al evaporation, electrical Ni plating or resin coating. Before the surface treatment, the sintered magnet body may also be subjected to a known pre-treatment such as sandblast abrasion process, barrel abrasion process, etching process or mechanical grinding. Optionally, after the diffusion process, the sintered magnet body may be ground to have its size adjusted. Even after having gone through any of these processes, the coercivity can also be increased almost as effectively as always. For the purpose of size adjustment, the sintered magnet body is preferably ground to a depth of 1 μm to 300 μm, more preferably to a depth of 5 μm to 100 μm, and even more preferably to a depth of 10 μm to 30 μm.

Embodiment 2

First, an alloy including 25 mass % to 40 mass % of rare-earth elements (0.1 mass % to 5.0 mass % of which is a heavy rare-earth element RH and the balance of which is a light rare-earth element RL), 0.6 mass % to 1.6 mass % of B (boron) and Fe and inevitably contained impurities as the balance is provided. A portion of B may be replaced with C (carbon) and a portion (50 at % or less) of Fe may be replaced with another transition metal element such as Co or Ni. For various purposes, this alloy may contain about 0.01 mass % to about 1.0 mass % of at least one additive element M that is selected from the group consisting of Al, Si, Ti, V, Cr, Mn, Ni, Cu, Zn, Ga, Zr, Nb, Mo, Ag, In, Sn, Hf, Ta, W, Pb and Bi.

In this manner, according to this preferred embodiment, 0.1 mass % to 5.0 mass % of heavy rare-earth element RH is added to the material alloy. Specifically, a known R—Fe—B based rare-earth sintered magnet, including a light rare-earth element RL (which is at least one of Nd and Pr) and 0.1 mass % to 5.0 mass % of heavy rare-earth element RH as the rare-earth elements R, is provided and the heavy rare-earth element RH is diffused from the surface toward the inside of the magnet by the evaporation diffusion process.

In this preferred embodiment, the R—Fe—B based rare-earth sintered magnet body yet to be subjected to the evaporation diffusion process includes, as a main phase, crystal grains of an $R_2Fe_{14}B$ type compound including a light rare-earth element RL as its major rare-earth element R and already includes 0.1 mass % to 5.0 mass % of heavy rare-earth element RH. This heavy rare-earth element RH is present both on the main phase and on the grain boundary phase. That is why compared to the situation where no heavy rare-earth element RH is added to the material alloy, the difference in the concentration of the heavy rare-earth element RH decreases on the surface of the sintered magnet body during the evaporation diffusion process. The intragrain diffusion into the main phase heavily depends on this concentration difference, and therefore, is reduced in this preferred embodiment. As a result, the grain boundary diffusion advances preferentially. Consequently, even if the amount of the heavy rare-earth element RH supplied onto the surface of the magnet body is decreased, the heavy rare-earth element RH can still be diffused effectively inside the sintered magnet body.

On the other hand, in the sintered magnet body to which no heavy rare-earth element RH has been added in advance, the difference in the concentration of the heavy rare-earth element RH increases on the surface, thus producing the intragrain diffusion into the main phase more often and decreasing the percentage of the grain boundary diffusion.

It should be noted that if the sintered magnet body yet to be subjected to the evaporation diffusion process included 5 mass % or more of heavy rare-earth element RH, the difference in the concentration of the heavy rare-earth element RH would also decrease at the grain boundary phase and the coercivity could not be increased so much by the evaporation diffusion process. That is why to produce the grain boundary diffusion of the heavy rare-earth element RH efficiently, the sintered magnet body yet to be subjected to the evaporation diffusion process preferably includes 1.5 mass % to 3.5 mass % of heavy rare-earth element RH.

According to this preferred embodiment, a sintered magnet body already including a predetermined amount of heavy rare-earth element RH is further subjected to the process of producing the grain boundary diffusion of the heavy rare-earth element RH from the surface of the sintered magnet body. As a result, the light rare-earth element RL can be replaced with RH very efficiently on the outer periphery of the main phase. As a result, the coercivity $H_{cJ}$ can be increased with the decrease in remanence $B_r$ minimized.

Embodiment 3

In a method of producing an R—Fe—B based rare-earth sintered magnet according to a third preferred embodiment of the present invention, the process step of sintering a compact of an R—Fe—B based rare-earth magnet powder and the process step of diffusing a heavy rare-earth element RH are performed continuously in the same processing chamber. More specifically, performed first is the process step (A) of arranging a compact of an R—Fe—B based rare-earth magnet powder, including a light rare-earth element RL (which is at least one of Nd and Pr) as a major rare-earth element R, in a processing chamber such that the compact faces a bulk body including a heavy rare-earth element RH, which is at least one element selected from the group consisting of Dy, Ho and Tb.

Next, the process step (B) of performing a sintering process in the processing chamber, thereby making an R—Fe—B based rare-earth sintered magnet body including crystal grains of an $R_2Fe_{14}B$ type compound as a main phase is carried out. After that, performed in that processing chamber is the process step (C) of heating the bulk body and the R—Fe—B based rare-earth sintered magnet body, thereby diffusing the heavy rare-earth element RH into the R—Fe—B based rare-earth sintered magnet body while supplying the heavy rare-earth element RH from the bulk body to the surface of the R—Fe—B based rare-earth sintered magnet body.

The process steps of this preferred embodiment are the same as the counterparts of the first preferred embodiment described above except the sintering and diffusing process step. Thus, only the process step unique to this preferred embodiment will be described.

Sintering and Diffusing Process Step

The sintering and diffusing process step of the third preferred embodiment will be described with reference to FIG. 2, which is a graph showing how the temperature and pressure of the atmospheric gas in the processing chamber change with time in the sintering and diffusing process step. In this graph, the one-dot chain curve represents the atmospheric gas pressure and the solid curve represents the atmospheric gas temperature.

First, a compact of the magnet powder and an RH bulk body are arranged in the processing chamber 6 shown in FIG. 1 and the pressure starts to be reduced (which is the process step (A)). In this process step, the compact of the magnet powder may be obtained by compacting a finely pulverized powder, which has been prepared by a known process to make a rare-earth sintered magnet, by a known process, too.

After the magnet powder compact and the RH bulk body have been arranged in the processing chamber 6, the temperature in the processing chamber 6 is raised to a predetermined temperature falling within the range of 1,000° C. to 1,200° C. to start a sintering process. The temperature is preferably not raised until the atmospheric gas pressure inside the processing chamber 6 has been lowered to a pressure of 1 Pa to $1\times10^5$ Pa for the sintering process. It is important to maintain the pressure during the sintering process at a relatively high level at which the vaporization of the RH bulk body can be reduced sufficiently. As described above, the rate of vaporization of the heavy rare-earth element RH from the RH bulk body is reduced significantly when the atmospheric gas pressure is high. That is why even if the powder compact and the RH bulk body are both present in the same processing chamber 6, the sintering process can be advanced without allowing the heavy rare-earth element RH to enter the powder compact by controlling the atmospheric gas pressure within an appropriate range.

The sintering process (which corresponds to the process step (B)) may be carried out by keeping the powder compact heated for 10 to 600 minutes within the atmospheric gas pressure and temperature ranges specified above. In this preferred embodiment, the atmospheric gas pressure is supposed to fall within the range of 1 Pa to $1\times10^5$ Pa when the temperature is raised and during the process step (B). That is why the sintering reaction advances quickly with the vaporization of the RH bulk body minimized. In the process step (B), if the atmospheric gas pressure were lower than 1 Pa, then the heavy rare-earth element RH would vaporize from the RH bulk body, thus making it difficult to advance only the sintering reaction. On the other hand, if the atmospheric gas pressure in the process step (B) exceeded $1\times10^5$ Pa, the gas might remain in the powder compact during the sintering process and some cavities could be left in the resultant sintered magnet. For these reasons, the atmospheric gas pressure in the process step (B) is preferably controlled so as to fall within the range of 1 Pa to $1\times10^5$ Pa, more preferably within the range of $5\times10^2$ Pa to $10^4$ Pa.

After the sintering process (i.e., the process step (B)) has been carried out, the atmospheric gas temperature inside the processing chamber 6 is lowered to a temperature of 800° C. to 950° C. (which will be referred to herein as a "process step ($B'_1$)") and then the atmospheric gas pressure is reduced to a pressure of $1\times10^{-5}$ Pa to 1 Pa (which will be referred to herein as a "process step ($B'_2$)"). A good temperature to diffuse the heavy rare-earth element RH is 800° C. to 950° C. In the process step ($B'_1$) to lower the temperature to this range, the vaporization of the RH bulk body is preferably minimized. In this preferred embodiment, after the atmospheric gas temperature has been lowered to a temperature of 800° C. to 950° C., the atmospheric gas pressure starts to be reduced (i.e., the process step ($B'_2$) gets started). In this manner, after the atmospheric gas temperature has been lowered to a preferred temperature for the evaporation diffusion process, the RH bulk body can start to be vaporized and the diffusion process step (C) can be carried out efficiently.

In the diffusion process step (C), the evaporation diffusion described above is advanced with the atmospheric gas pressure maintained within the range of $1\times10^{-5}$ Pa to 1 Pa and with the temperature in the processing chamber maintained within the range of 800° C. to 950° C. In this diffusion process step (C), the grain boundary diffusion occurs preferentially as a result of the evaporation diffusion process. Consequently, the formation of an intragrain diffusion layer can be reduced and the decrease in remanence $B_r$ can be minimized.

Figure 2:
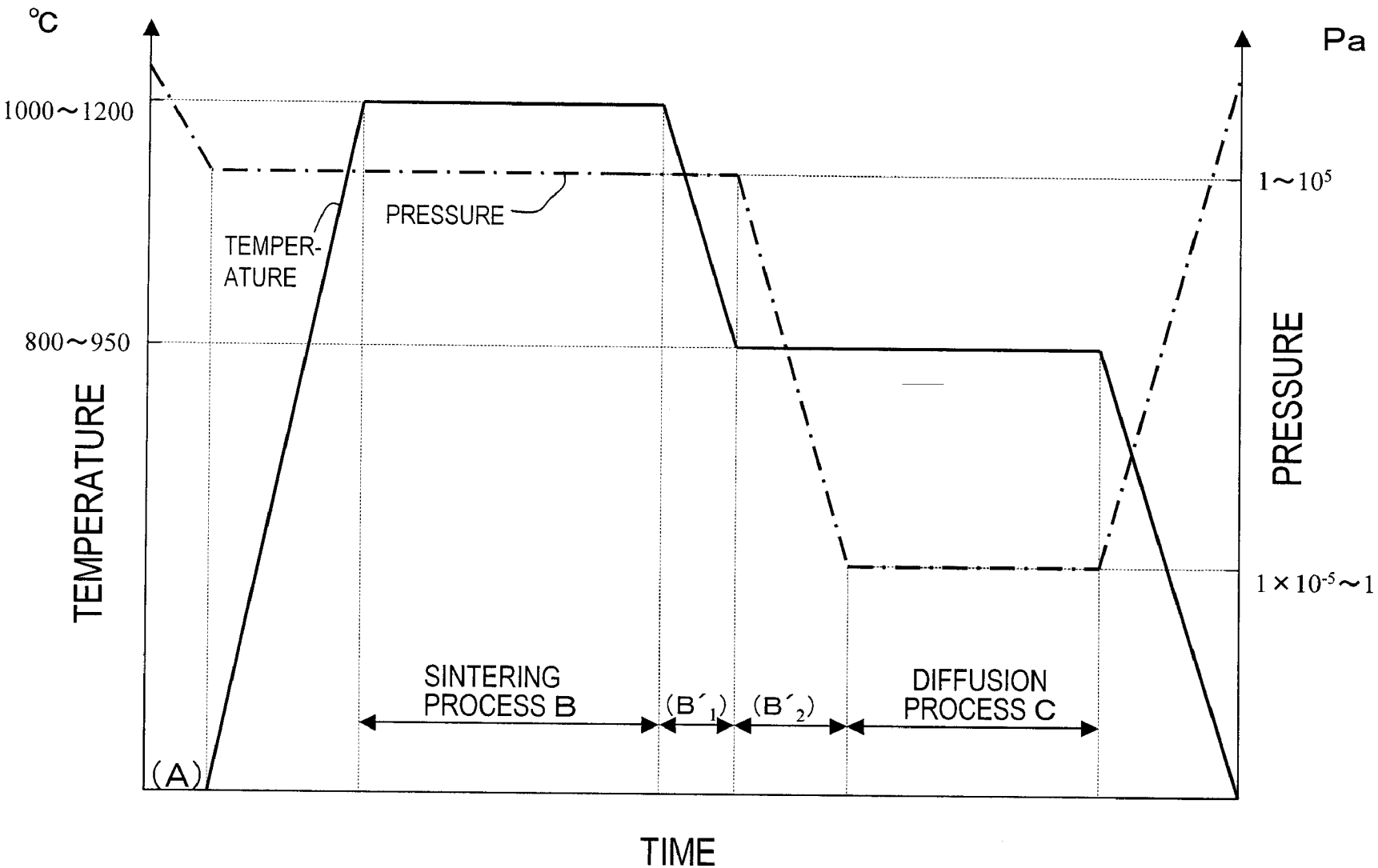
FIG. 2 is a graph showing how the temperature and pressure of the atmospheric gas in the processing chamber may change with time in a sintering and diffusing process according to the present invention, where the one-dot chain curve represents the atmospheric gas pressure and the solid curve represents the atmospheric gas temperature.
Figure 3:
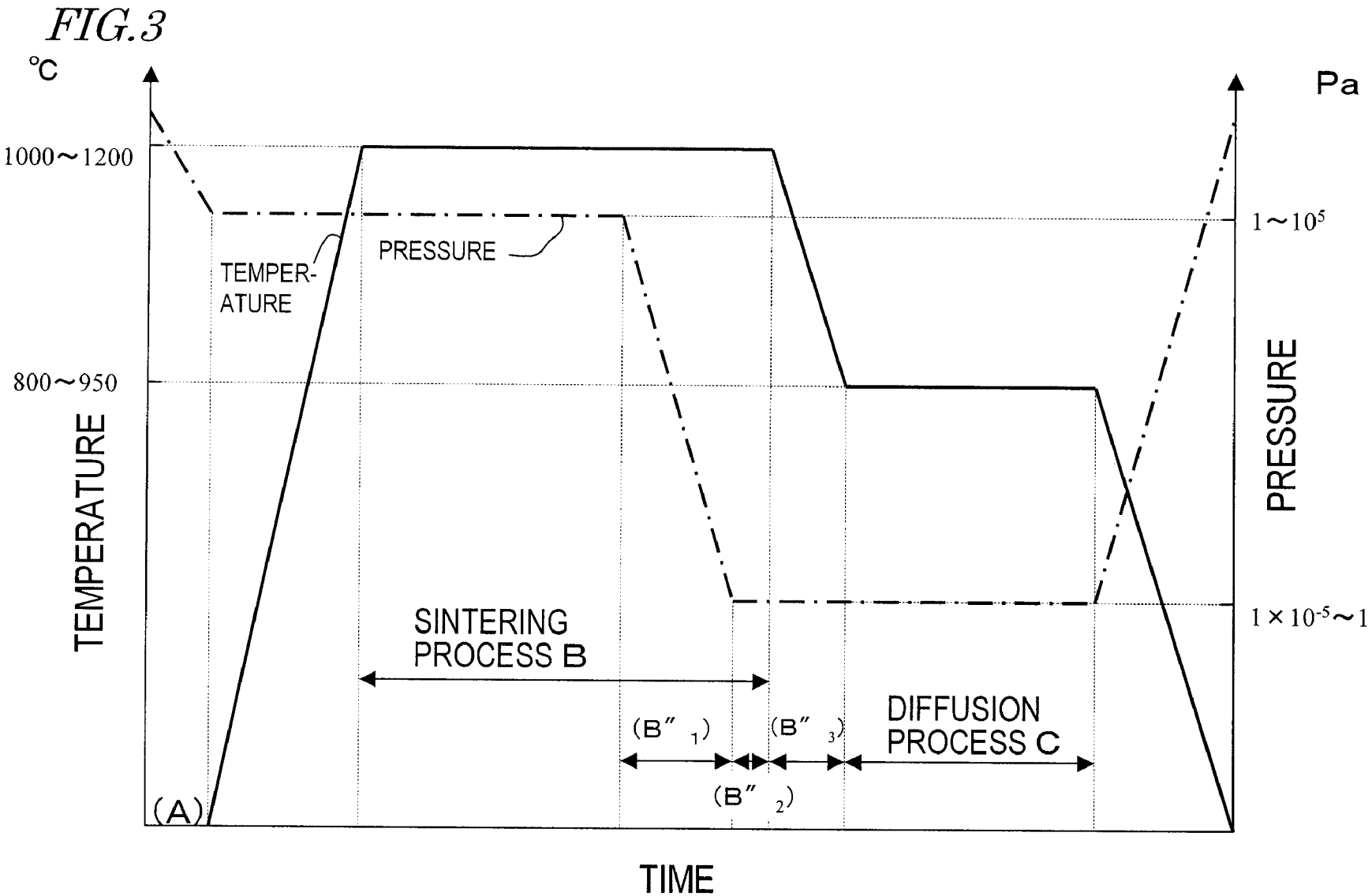
FIG. 3 is a graph showing how the temperature and pressure of the atmospheric gas in the processing chamber may also change with time in the sintering and diffusing process of the present invention, where the one-dot chain curve represents the atmospheric gas pressure and the solid curve represents the atmospheric gas temperature.

FIG. 3 is a graph showing different variations in pressure and temperature from those of the preferred embodiment shown in FIG. 2. In the example shown in FIG. 3, before the sintering process step (B) ends, the atmospheric gas pressure is reduced in the process step ($B''_1$). Next, after a heat treatment has been conducted for 10 to 300 minutes at an atmospheric gas pressure of $1\times10^{-5}$ Pa to 1 Pa and at a temperature of 1,000° C. to 1,200° C. in the processing chamber in the process step ($B''_2$), the temperature in the processing chamber 6 is lowered to a temperature of 800° C. to 950° C. in the process step ($B''_3$). According to the example shown in FIG. 3, the RH bulk body starts to vaporize during the sintering process step (B), and therefore, the total process time can be shortened.

It should be noted that before the sintering process step is started, the temperature does not always have to be increased at a constant rate as shown in FIG. 2 or 3. Alternatively, the process step of maintaining the powder compact at a temperature of 650° C. to 1,000° C. for 10 to 240 minutes while the temperature is being increased may be added.

Also, the diffusion process of this preferred embodiment is not sensitive to the surface status of the sintered magnet body, and therefore, a film of Al, Zn or Sn may be deposited on the surface of the sintered magnet body before the diffusion process. This is because Al, Zn and Sn are low-melting metals and because a small amount of Al, Zn or Sn would not deteriorate the magnetic properties or would not interfere with the diffusion, either. Optionally, the element such as Al, Zn or Sn may be included in the RH bulk body.

As can be seen easily from the foregoing description, according to this preferred embodiment, the grain boundary diffusion of a heavy rare-earth element RH (which is at least one element selected from the group consisting of Dy, Ho and Tb) is produced without significantly changing the conventional process, thereby supplying the heavy rare-earth element RH deep into a sintered magnet body and replacing a light rare-earth element RL with the heavy rare-earth element RH efficiently on the outer periphery of the main phase. As a result, the coercivity $H_{cJ}$ can be increased with the decrease in remanence $B_r$ minimized.

EXAMPLES

Example 1

An alloy was prepared by a strip casting process so as to have a composition consisting of 31.8 mass % of Nd, 0.97 mass % of B, 0.92 mass % of Co, 0.1 mass % of Cu, 0.24 mass % of Al and Fe as the balance, thereby making thin alloy flakes with thicknesses of 0.2 mm to 0.3 mm.

Next, a container was loaded with those thin alloy flakes and then introduced into a hydrogen pulverizer, which was filled with a hydrogen gas atmosphere at a pressure of 500 kPa. In this manner, hydrogen was occluded into the thin alloy flakes at room temperature and then released. By performing such a hydrogen process, the thin alloy flakes were decrepitated to obtain a powder in indefinite shapes with sizes of about 0.15 mm to about 0.2 mm.

Thereafter, 0.05 wt % of zinc stearate was added to the coarsely pulverized powder obtained by the hydrogen process and then the mixture was pulverized with a jet mill to obtain a fine powder with a size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at 1,020° C. for four hours in a vacuum furnace, thus obtaining sintered blocks, which were then machined and cut into sintered magnet bodies with a thickness of 1 mm, a length of 10 mm and a width of 10 mm.

These sintered magnet bodies were acid-cleaned with a 0.3% nitric acid aqueous solution, dried, and then arranged in a process vessel with the configuration shown in FIG. 1. The process vessel for use in this preferred embodiment was made of Mo and included a member for holding a plurality of sintered magnet bodies and a member for holding two RH bulk bodies. A gap of about 5 mm to about 9 mm was left between the sintered magnet bodies and the RH bulk bodies. The RH bulk bodies were made of Dy with a purity of 99.9% and had dimensions of 30 mm×30 mm×5 mm.

Next, the process vessel shown in FIG. 1 was heated in a vacuum heat treatment furnace to conduct a heat treatment. The conditions for the heat treatment are as shown in the following Table 1. It should be noted that the "heat treatment temperature" will mean herein the temperature of the sintered magnet bodies and that of the RH bulk bodies, which is approximately equal to that of the sintered magnet bodies, unless otherwise stated.

TABLE 1

| Condition | Temperature [° C.] | Time [min.] | Pressure [Pa] |
|---|---|---|---|
| X | 900 | 30 | $1.0 \times 10^{-2}$ |
| Y | | 180 | |
| Z | 950 | | |

After the heat treatment was carried out under the conditions shown in Table 1, an aging treatment was performed for 60 minutes at a pressure of 2 Pa and at a temperature of 500° C.

Meanwhile, another sample was prepared by coating the surface of a sintered magnet body with Al (to a thickness of 1 μm) by an electron beam heating evaporation process (at an output of 16 kW for 30 minutes) using a barrel, and subjected to the heat treatment under the conditions X and Y shown in Table 1. After that, the sample was subjected to an aging treatment for 60 minutes at a pressure of 2 Pa and at a temperature of 500° C.

Each sample was magnetized with pulses with an intensity of 3 MA/m and then the properties of the magnet (including its remanence $B_r$ and coercivity $H_{cJ}$) were measured with a B-H tracer. Also, it was estimated with an EPMA EPM-810 (produced by Shimadzu Corporation) how and where Dy diffused inside the magnet. The remanences $B_r$ and coercivities $H_{cJ}$ measured are shown in the following Table 2:

TABLE 2

| Sample # | Al coating | Heat treatment condition | Br [T] | HcJ [kA/m] |
|---|---|---|---|---|
| 1 | NO | No diffusion | 1.40 | 850 |
| 2 | NO | X | 1.40 | 1,211 |
| 3 | YES | X | 1.39 | 1,228 |
| 4 | NO | Y | 1.39 | 1,402 |
| 5 | YES | Y | 1.38 | 1,422 |
| 6 | NO | Z | 1.37 | 1,601 |

Sample #1 representing a comparative example was not subjected to an evaporation diffusion process of Dy but was subjected to an aging treatment under the same heat treatment condition as Samples #2 to #6. As can be seen from Table 2, Samples #2 to #6, which were subjected to the Dy diffusion process of the present invention, had much increased coercivities $H_{cJ}$ compared to Sample #1 representing a comparative example. The present inventors also discovered that even in Samples #3 and #4 in which an Al coating was deposited to a thickness of 1 μm on the surface of the sintered magnet body before the diffusion process, the presence of the Al coating did not particularly interfere with the diffusion of Dy but the coercivity $H_{cJ}$ could also be increased.

Figure 4:
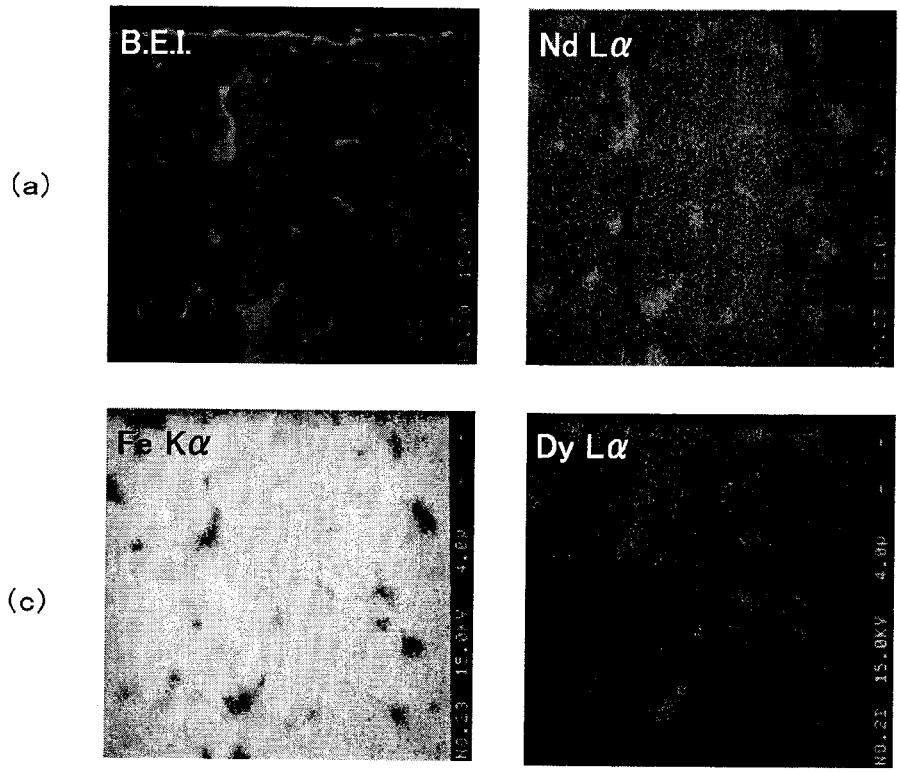
FIG. 4 is a set of photographs showing the results of a sectional EPMA analysis that was carried out on Sample #2, representing a specific example of the present invention, wherein FIGS. 4(*a*), 4(*b*), 4(*c*) and 4(*d*) are mapped photographs representing a backscattered electron image (BEI) and the distributions of Nd, Fe and Dy, respectively.
Figure 5:
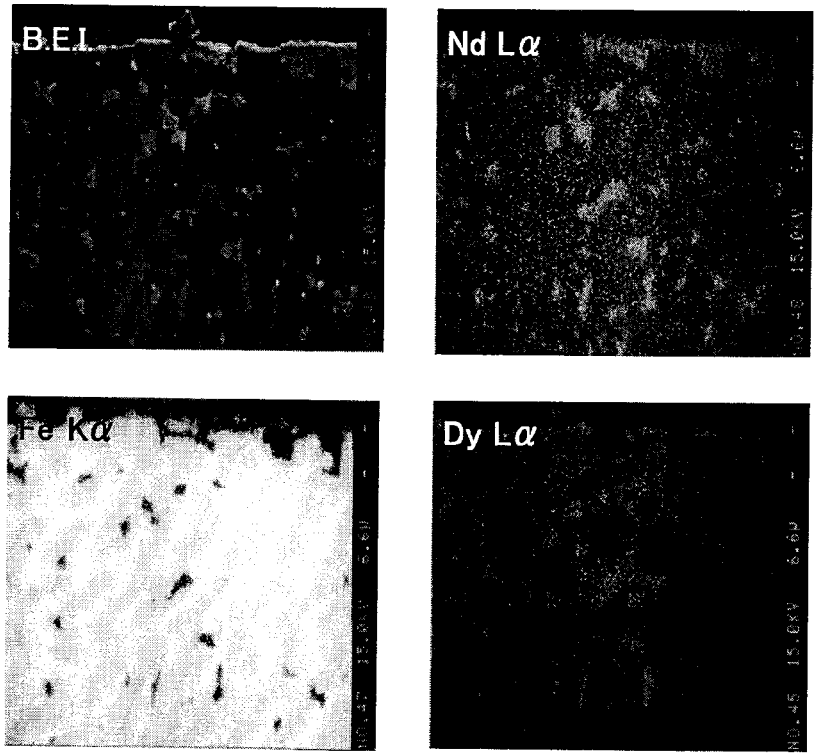
FIG. 5 is a set of photographs showing the results of a sectional EPMA analysis that was carried out on Sample #4, representing another specific example of the present invention, wherein FIGS. 5(*a*), 5(*b*), 5(*c*) and 5(*d*) are mapped photographs representing a backscattered electron image (BEI) and the distributions of Nd, Fe and Dy, respectively.

FIGS. 4 and 5 are photographs showing the results of sectional EPMA analyses that were carried out on Samples #2 and #4. Specifically, FIGS. 4(*a*), 4(*b*), 4(*c*) and 4(*d*) are mapped photographs representing a backscattered electron image (BEI) and the distributions of Nd, Fe and Dy, respectively. The same goes for FIG. 5. In each of these photographs, the upper surface corresponds to the surface of the sintered magnet body.

In the photographs shown in FIGS. 4(*d*) and 5(*d*), portions with relatively high Dy concentrations have bright shades. As can be seen from these photographs, Dy with relatively high concentrations was present in the vicinity of the grain boundary. Even in the vicinity of the surface of the magnet, Dy diffused to have similar concentrations to the vicinity of the grain boundary at the center of very few main phases. According to the method in which a Dy film was deposited on the surface of a sintered magnet body and then Dy was diffused from the Dy film into the sintered magnet body, a lot of main phases in which Dy diffused to have high concentrations were observed in the vicinity of the surface of the sintered magnet body.

According to the present invention, even in the surface region of a sintered magnet body with a depth of up to 100 μm as measured from the surface, no Dy diffused to reach the center of the main phases (i.e., crystal grains of an $Nd_2Fe_{14}B$ compound) and the Dy concentration was lower at the center of the main phases than in the vicinity of the grain boundary. This means that before the intragrain diffusion advanced in the surface region, Dy had already diffused through the grain boundary phase to reach deep inside the sintered magnet body. As a result, a rare-earth sintered magnet, of which the coercivity $H_{cJ}$ was increased almost without decreasing the remanence $B_r$, could be obtained.

Figure 6:
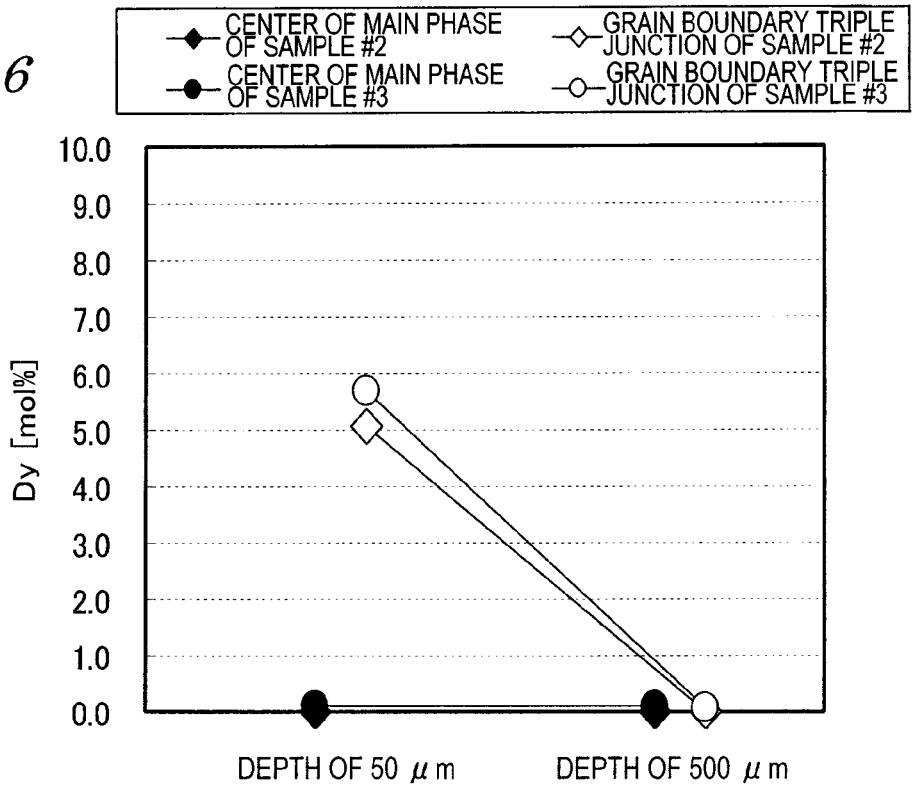
FIG. 6 is a graph showing the Dy concentrations that were measured at the center of main phases and at the grain boundary triple junction of Samples #2 and #3 representing specific examples of the present invention.

FIG. 6 shows the Dy concentrations that were measured at the center of main phases and at the grain boundary triple junction of Samples #2 and #3. In FIG. 6, the Dy concentrations measured at the center of main phases and at the grain boundary triple junction of Samples #2 are represented by the solid diamond ◆ and by the open diamond ◇, respectively, while the Dy concentrations measured at the center of main phases and at the grain boundary triple junction of Samples #3 are represented by the solid circle ● and by the open circle ○, respectively.

In a region with a depth of approximately 50 μm as measured from the surface of the sintered magnet bodies, the Dy concentrations at the center of the main phases were very low, whereas the Dy concentrations at the grain boundary triple junctions were much higher. On the other hand, in a region with a depth of approximately 500 μm as measured from the surface of the sintered magnet bodies, almost no Dy was detected in any of these two samples.

Figure 7:
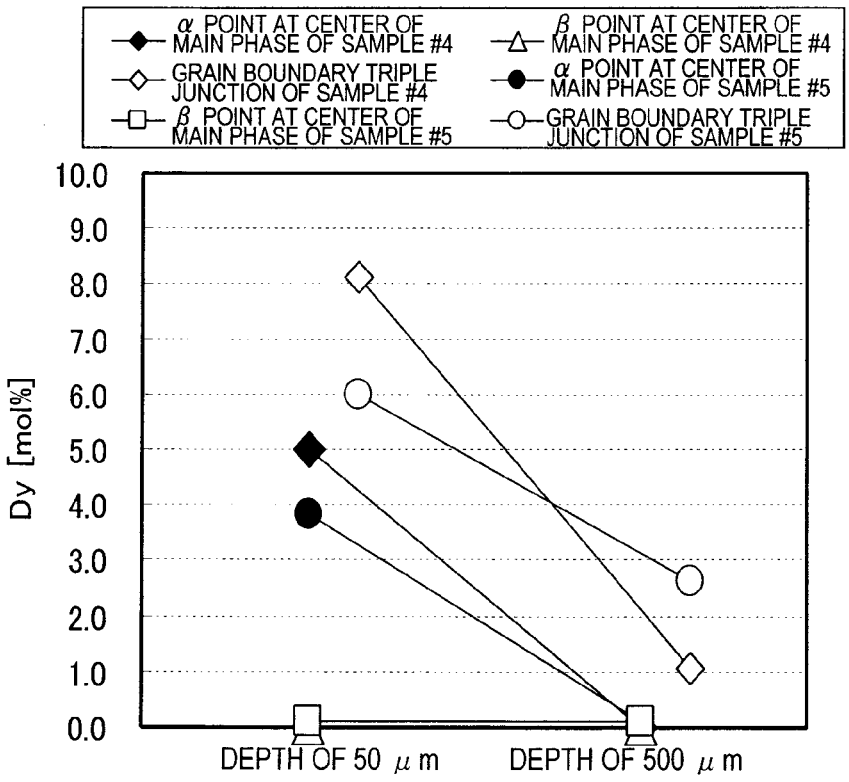
FIG. 7 is a graph showing the Dy concentrations that were measured at the center of main phases and at the grain boundary triple junction of Samples #4 and #5 representing other specific examples of the present invention.

FIG. 7 shows the Dy concentrations that were measured at the centers of the main phases and at the grain boundary triple junctions of Samples #4 and #5. As for the centers of the main phases of Samples #4 and #5, a point with the highest Dy concentration will be identified by α and a point with the lowest Dy concentration will be identified by β. In Sample #4, the Dy concentrations at the α and β points at the center of the main phase and at the grain boundary triple junction are represented by the solid diamond ◆, the open triangle Δ and the open diamond ◇, respectively. On the other hand, in Sample #5, the Dy concentrations at the α and β points at the center of the main phase and at the grain boundary triple junction are represented by the solid circle ●, the open square □ and the open circle ○, respectively.

As can be seen from these results, in each of these samples, there was a difference of at least 2 mol % (=2 at %) in Dy concentration between the center of the main phase and the grain boundary phase.

Example 2

Sintered magnet bodies were made by the same method as that already described for the first example and had dimensions of 7 mm×7 mm×3 mm. The magnetization direction was defined as the direction of the thickness of 3 mm. Those sintered magnet bodies were acid-cleaned with a 0.3% nitric acid, dried, and then arranged so as to face a Dy plate with dimensions of 30 mm×30 mmX 5 mm and with a purity of 99.9% as shown in FIG. 1.

Next, the process vessel shown in FIG. 1 was heated in a vacuum heat treatment furnace to conduct a heat treatment under the conditions shown in the following Table 3. After that, an aging treatment was performed for 60 minutes at a pressure of 2 Pa and at a temperature of 500° C.

TABLE 3

| Pressure | 750° C. | 800° C. | 850° C. | 900° C. | | 950° C. |
|---|---|---|---|---|---|---|
| [Pa] | | 30 min | | 30 min | 120 min | 30 min |
| $1 \times 10^{-2}$ | Sample 8 | Sample 9 | Sample 10 | Sample 11 | Sample 12 | Sample 13 |
| 1.0 | — | — | — | Sample 14 | — | — |
| $1 \times 10^{2}$ | — | — | — | Sample 15 | — | — |
| $1 \times 10^{5}$ Atmospheric pressure Ar flow | — | — | — | Sample 16 | — | — |

A comparative example that was subjected to an aging treatment under the same conditions as those of the second example without being subjected to any diffusion process will be referred to herein as "Sample #7". After the aging treatment, the properties of the magnet (including its remanence $B_r$ and coercivity $H_{cJ}$) were measured with a B-H tracer. The results are shown in the following Table 4:

TABLE 4

| Sample # | $B_r$ [T] | $H_{cJ}$ [kA/m] |
|---|---|---|
| 7 | 1.42 | 911 |
| 8 | 1.42 | 923 |
| 9 | 1.42 | 943 |
| 10 | 1.42 | 1,079 |
| 11 | 1.42 | 1,112 |
| 12 | 1.40 | 1,352 |
| 13 | 1.40 | 1,298 |
| 14 | 1.42 | 1,143 |
| 15 | 1.42 | 1,100 |
| 16 | 1.42 | 909 |

As can be seen from these results, although the thickness of the sintered magnet bodies was 3 mm in this example, the coercivity $H_{cJ}$ could be increased significantly almost without decreasing the remanence $B_r$.

Figure 8:
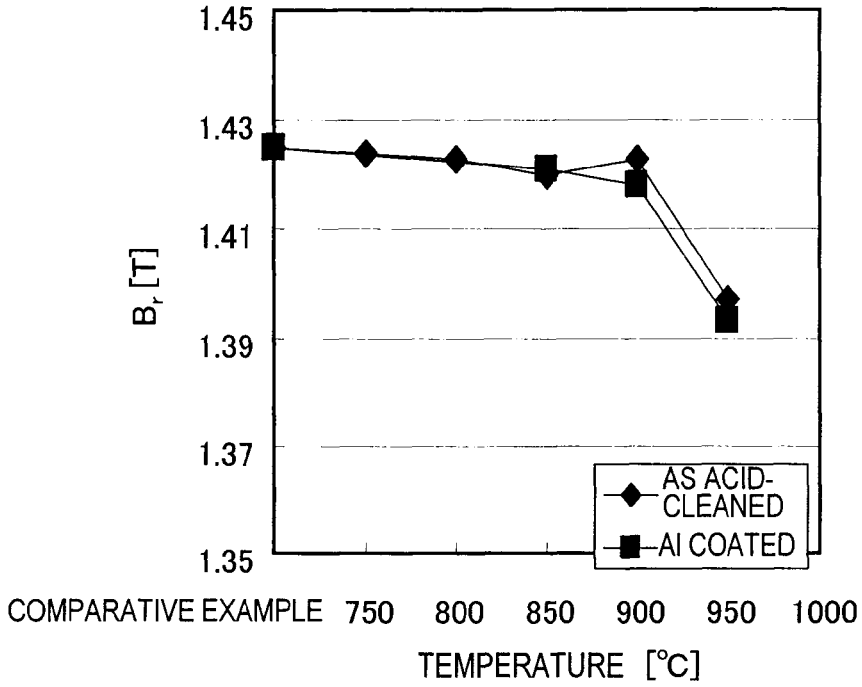
FIGS. 8(*a*) and 8(*b*) are graphs respectively showing how the remanence $B_r$ and the coercivity $H_{cJ}$ change with the process temperature.
Figure 8:
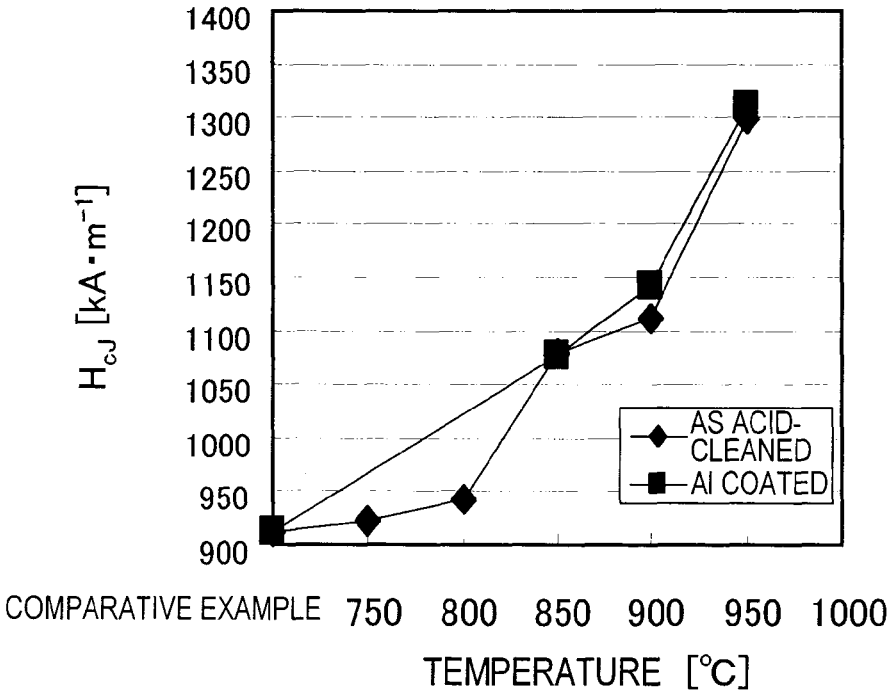

FIGS. 8(*a*) and 8(*b*) are graphs showing how the remanence $B_r$ and the coercivity $H_{cJ}$ change with the process temperature. As can be seen from these graphs, as the temperature of the process (which was performed at a pressure of $1\times10^{-2}$ Pa for 30 minutes) increased, the coercivity $H_{cJ}$ increased. In these graphs, "as acid-cleaned" refers to a sample in which the surface of the sintered magnet body was cleaned with a 0.3% nitric acid and then covered with no coating, while "Al-coated" refers to a sample in which an Al film was deposited on the surface of the sintered magnet body by an electron beam heating evaporation process.

Figure 9:
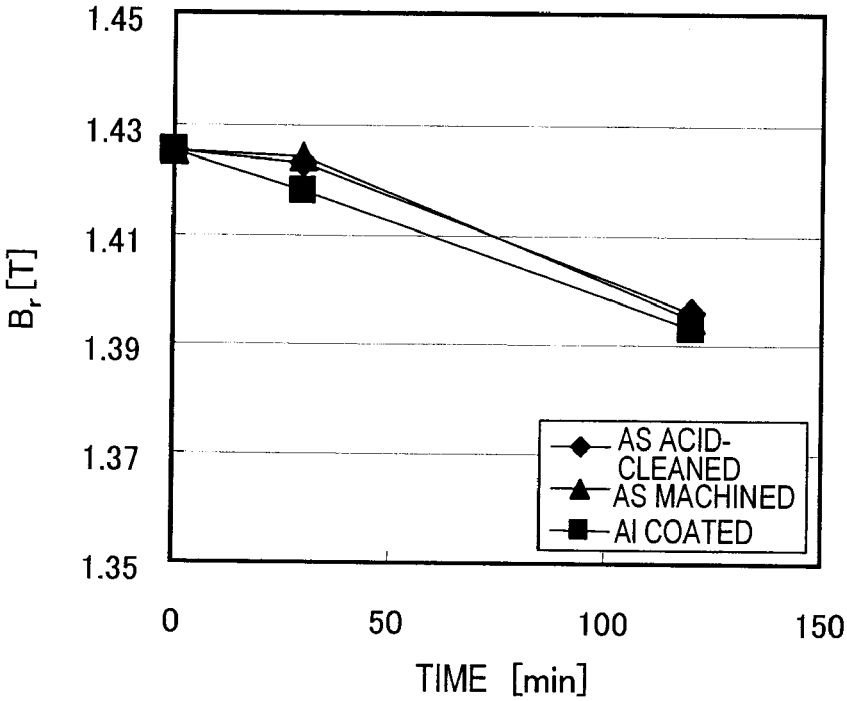
FIGS. 9(*a*) and 9(*b*) are graphs respectively showing how the remanence $B_r$ and the coercivity $H_{cJ}$ change with the process time.
Figure 9:
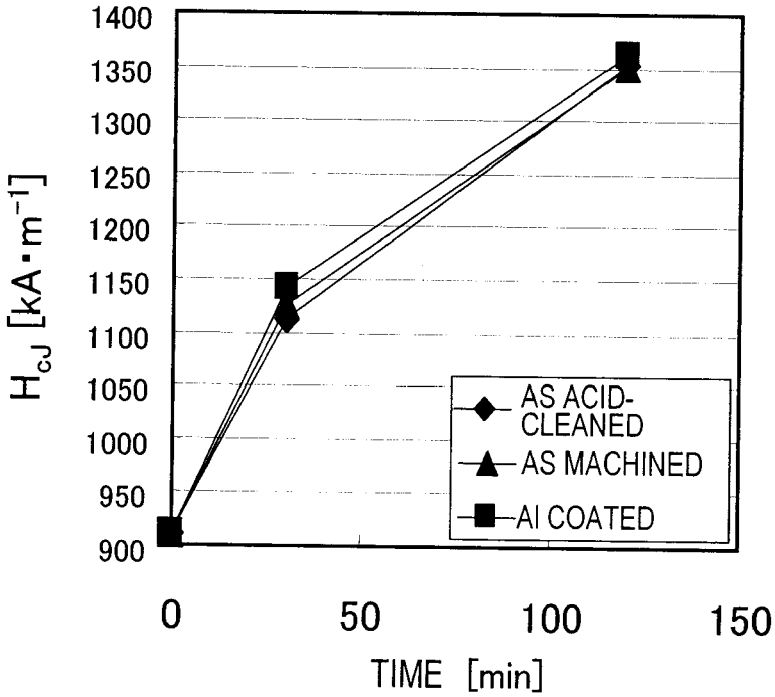

FIGS. 9(*a*) and 9(*b*) are graphs showing how the remanence $B_r$ and the coercivity $H_{cJ}$ change with the process time. As can be seen from these graphs, as the duration of the process (which was performed at a pressure of $1\times10^{-2}$ Pa and at a temperature of 900° C.) increased, the coercivity $H_{cJ}$ increased. In these graphs, "as acid-cleaned" and "Al-coated" refer to the samples as described above, and "as cut" refers to a product that had just been cut with a diamond cutter.

Figure 10:
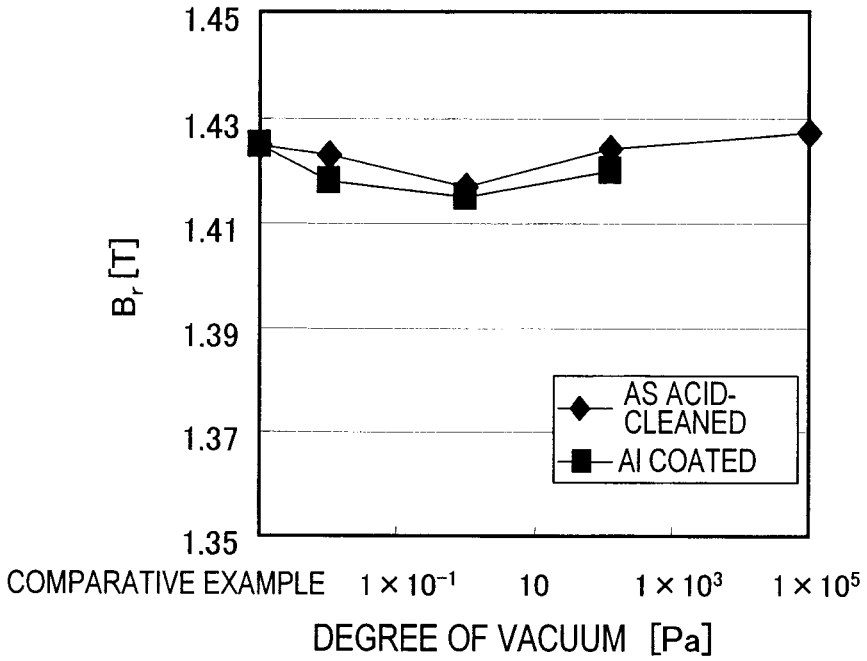
FIGS. 10(*a*) and 10(*b*) are graphs respectively showing how the remanence $B_r$ and the coercivity $H_{cJ}$ change with the atmospheric gas pressure.
Figure 10:
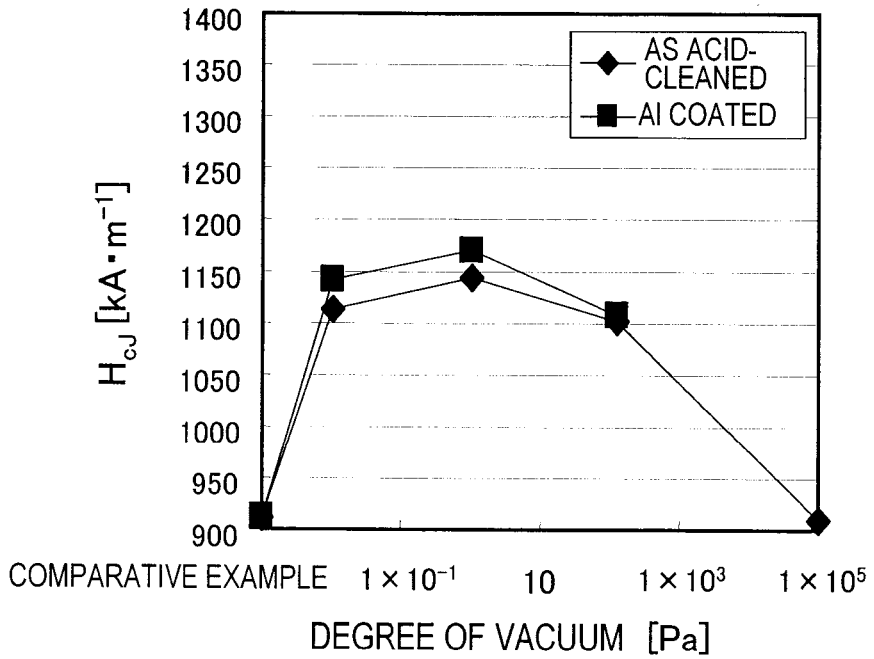

FIGS. 10(*a*) and 10(*b*) are graphs showing how the remanence $B_r$ and coercivity $H_{cJ}$ change with the pressure in the process vessel. In these graphs, the abscissa represents the pressure of the argon gas atmosphere in the process vessel. As can be seen from FIG. 10(*b*), if the pressure was $1\times10^{-2}$ Pa or less, the coercivity $H_{cJ}$ hardly depended on the pressure. And when the pressure was $1\times10^{5}$ Pa (which is the atmospheric pressure), the coercivity $H_{cJ}$ could not be increased at all. As a result of an EPMA analysis that was carried out on the surface of the magnet, it was discovered that when the pressure in the process vessel was equal to the atmospheric pressure, no Dy diffused or evaporated. These results reveal that if the pressure of the processing atmosphere is sufficiently high, it is possible to prevent Dy from evaporating and diffusing on a nearby sintered magnet body even when the Dy plate is heated. For that reason, by controlling the atmospheric gas pressure, the sintering process and the Dy evaporation and diffusion process may be carried out sequentially in the same processing chamber. Specifically, when the sintering process is carried out, the atmospheric gas pressure is increased so much as to prevent Dy from evaporating and diffusing from the Dy plate. And if the atmospheric gas pressure is reduced after the sintering process has ended, Dy can be supplied from the Dy plate to the sintered magnet body and can be made to diffuse into the sintered magnet body. If the sintering process and the Dy diffusion process can be carried out in the same system in this manner, the manufacturing cost can be reduced.

Example 3

Figure 11:
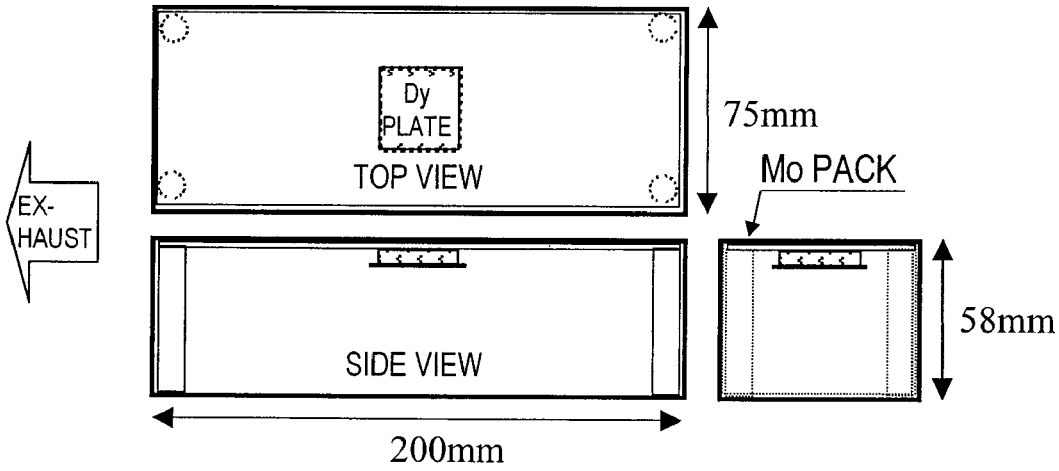
FIG. 11 is a cross-sectional view showing an arrangement in an Mo pack that was used in a specific example of the present invention.

In this example, it was analyzed how the deposition of Dy was affected by the pressure (or the degree of vacuum) of the atmospheric gas in the processing chamber. Specifically, according to this example, an Mo vessel (which will be referred to herein as an "Mo pack") shown in FIG. 11 was used and a Dy plate with dimensions of 30 mm×30 mm×5 mm and with a purity of 99.9% was installed inside the Mo pack. Nb foil was attached to the inner walls of the Mo pack. The Mo pack shown in FIG. 11 was loaded into a vacuum heat treatment furnace and was subjected to a heat treatment at 900° C. for 180 minutes. The pressures (or degrees of vacuums) inside the vacuum heat treatment furnace were (1) $1\times10^{-2}$ Pa, (2) 1 Pa and (3) 150 Pa.

Figure 12:
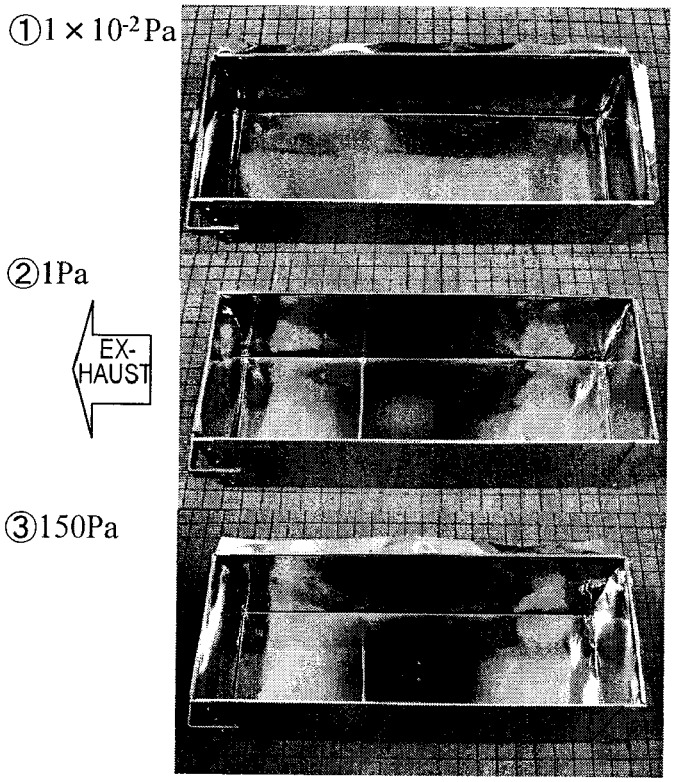
FIG. 12 is a set of photographs showing how the appearance of the inner walls of the Mo pack changed after the heat treatment process.

FIG. 12 is a set of photographs showing how the appearance of the inner walls of the Mo pack changed after the heat treatment process. The discolored portions on the inner walls of the Mo pack are Dy deposited regions. At the degree of vacuum (1), Dy was deposited uniformly all over the inner walls of the Mo pack. At the degree of vacuum (2), Dy was deposited only near the Dy plate. And at the degree of vacuum (3), the amount of Dy vaporized decreased and the area of the Dy deposited region decreased, too. It should be noted that almost no Dy film would have been formed on the discolored portions. That is to say, Dy, which had been deposited on the discolored portions of the inner walls once, would have vaporized again. By adjusting the degree of vacuum of the heat treatment atmosphere in this manner, the vaporization rate (amount) and the deposition region of Dy can be controlled.

Example 4

Figure 13:
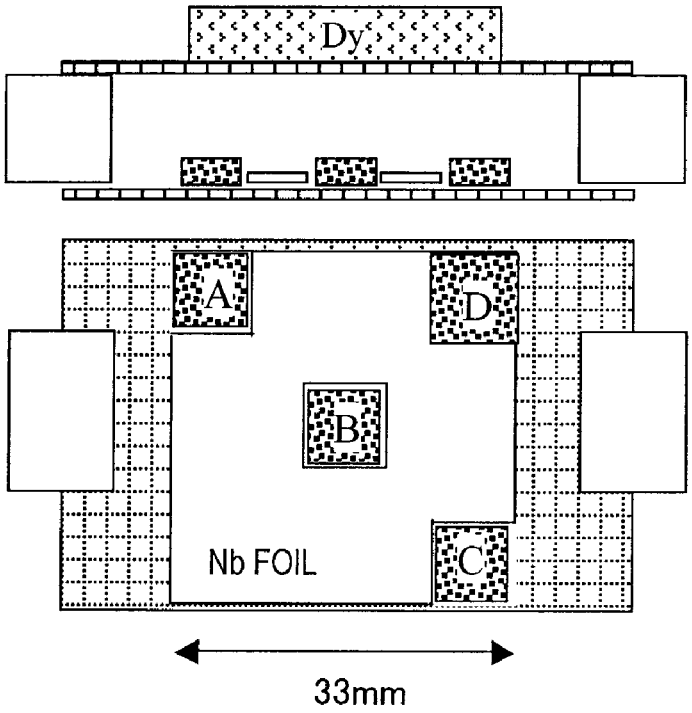
FIG. 13 is a cross-sectional view showing an arrangement in an Mo pack that was used in a specific example of the present invention.

Sintered magnet bodies that had been made by the same method as that described for the first example and a Dy plate with dimensions of 30 mm×30 mm×5 mm and a purity of 99.9% were arranged as shown in FIG. 13 and subjected to a heat treatment at 900° C. for 120 minutes in a vacuum heat treatment furnace. The degrees of vacuums were changed in the order of (1) $1\times10^{-2}$ Pa, (2) 1 Pa and (3) 150 Pa.

Samples A, B and C of sintered magnet bodies shown in FIG. 13 had dimensions of 7 mm×7 mm×3 mm (the last one is the thickness defining the magnetization direction) and only Sample D had dimensions of 10 mm×10 mm×1.2 mm (the last one is the thickness defining the magnetization direction). Each of these sintered magnet bodies was acid-cleaned with a 0.3% nitric acid, dried, and then subjected to a heat treatment.

After these sintered magnet bodies were further subjected to an aging treatment at 500° C. for 60 minutes at a degree of vacuum of 2 Pa, the properties of the magnet (including the remanence $B_r$ and coercivity $H_{cJ}$) were measured with a B-H tracer. The following Table 5 shows the weights and other data of Samples A through D and their magnetic properties measured at the degrees of vacuums (1), (2) and (3):

TABLE 5

| | Weight (g) before process | Weight (g) after process | Difference (g) | Area ($mm^2$) | Rate of increase ($g/mm^2$) | Total (g) | Yield (%) | Br (T) | HcJ (kA/m) |
|---|---|---|---|---|---|---|---|---|---|
| (1) | | | | | | | | | |
| Dy plate | 32.065 | 31.984 | −0.081 | 2400 | $-3.4\times10^{-5}$ | −0.081 | 45.7 | — | — |
| Nb foil | 0.358 | 0.359 | 0.001 | 1552 | $6.4\times10^{-7}$ | 0.037 | | — | — |
| A | 1.120 | 1.137 | 0.017 | 182 | $9.3\times10^{-5}$ | | | 1.41 | 1299 |
| B | 1.129 | 1.138 | 0.009 | 182 | $4.9\times10^{-5}$ | | | 1.41 | 1318 |
| C | 1.131 | 1.137 | 0.005 | 182 | $2.7\times10^{-5}$ | | | 1.41 | 1290 |
| D | 0.520 | 0.525 | 0.005 | 248 | $2.0\times10^{-5}$ | | | 1.41 | 1319 |
| (2) | | | | | | | | | |
| Dy plate | 31.984 | 31.948 | −0.036 | 2400 | $-1.5\times10^{-5}$ | −0.036 | 77.8 | — | — |
| Nb foil | 0.363 | 0.364 | 0.001 | 1552 | $6.4\times10^{-7}$ | 0.028 | | — | — |
| A | 1.130 | 1.136 | 0.006 | 182 | $3.3\times10^{-5}$ | | | 1.41 | 1299 |
| B | 1.130 | 1.139 | 0.009 | 182 | $4.9\times10^{-5}$ | | | 1.41 | 1303 |
| C | 1.131 | 1.138 | 0.007 | 182 | $3.8\times10^{-5}$ | | | 1.41 | 1300 |
| D | 0.513 | 0.518 | 0.005 | 248 | $2.0\times10^{-5}$ | | | 1.41 | 1320 |
| (3) | | | | | | | | | |

TABLE 5-continued

| | Weight (g) before process | Weight (g) after process | Difference (g) | Area ($mm^2$) | Rate of increase ($g/mm^2$) | Total (g) | Yield (%) | Br (T) | HcJ (kA/m) |
|---|---|---|---|---|---|---|---|---|---|
| Dy plate | 33.668 | 33.662 | −0.006 | 2400 | $-2.5 \times 10^{-6}$ | −0.006 | 83.3 | — | — |
| Nb foil | 0.352 | 0.353 | 0.001 | 1552 | $6.4 \times 10^{-7}$ | 0.005 | | — | — |
| A | 1.131 | 1.132 | 0.001 | 182 | $5.5 \times 10^{-6}$ | | | 1.42 | 1164 |
| B | 1.130 | 1.131 | 0.001 | 182 | $5.5 \times 10^{-6}$ | | | 1.42 | 1192 |
| C | 1.128 | 1.129 | 0.001 | 182 | $5.5 \times 10^{-6}$ | | | 1.42 | 1180 |
| D | 0.512 | 0.513 | 0.001 | 248 | $4.0 \times 10^{-6}$ | | | 1.42 | 1200 |

As can be seen from Table 5, the properties of the sintered magnet bodies A through D improved almost without variations. Dy yields were calculated based on the variations in weight before and after the heat treatment shown in Table 5. In this case, the "Dy yield" is given by (the increase in Dy of the member being processed (such as the sintered magnet body or the Nb foil)/(decrease in the weight of the Dy plate)×100. The lower the degree of vacuum, the higher the Dy yield. At the degree of vacuum (3), the Dy yield was approximately 83%. Also, at every degree of vacuum (1), (2) or (3), the rate of increase in the weight of the Nb foil per unit area was much lower than in the sintered magnet body. This result reveals that on the surface of Nb that does not react to (i.e., does not make an alloy with) Dy, the Dy particles that have traveled to reach the Nb surface and get deposited there temporarily vaporize again and do not contribute to forming a Dy film on the Nb foil. In other words, the Dy particles that have vaporized from the Dy plate evaporate and diffuse on the sintered magnet body preferentially. Consequently, compared to other conventional diffusion processes, the Dy yield can be increased significantly, thus contributing to saving valuable natural resources immensely.

Example 5

Figure 14:
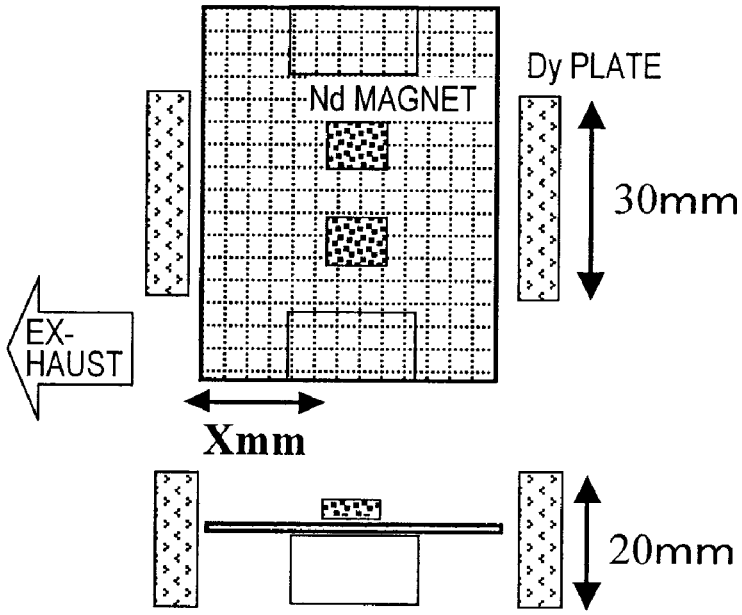
FIG. 14 illustrates an arrangement of Dy plates and sintered magnet bodies in another specific example of the present invention.

Sintered magnet bodies that had been made by the same method as that described for the first example and a Dy plate with dimensions of 20 mm×30 mm×5 mm and a purity of 99.9% were arranged as shown in FIG. 14 and subjected to a heat treatment at 900° C. and at $1\times10^{-2}$ Pa. In this example, the distance between the magnet and the Dy plate was changed as shown in the following Table 6. The sintered magnet bodies had dimensions of 7 mm×7 mm×3 mm (the last one is the thickness defining the magnetization direction) and had been acid-cleaned with a 0.3% nitric acid and dried. After having been subjected to a heat treatment, these sintered magnet bodies were further subjected to an aging treatment at 500° C. for 60 minutes at a degree of vacuum of 2 Pa, and then the properties of the magnet (including the remanence $B_r$ and coercivity $H_{cJ}$) were measured with a B-H tracer.

TABLE 6

| | X/mm | | | |
|---|---|---|---|---|
| | 15 | 30 | 80 | 160 |
| 30 min. | ① | ② | ③ | — |
| 120 min. | — | ④ | ⑤ | ⑥ |

Figure 15:
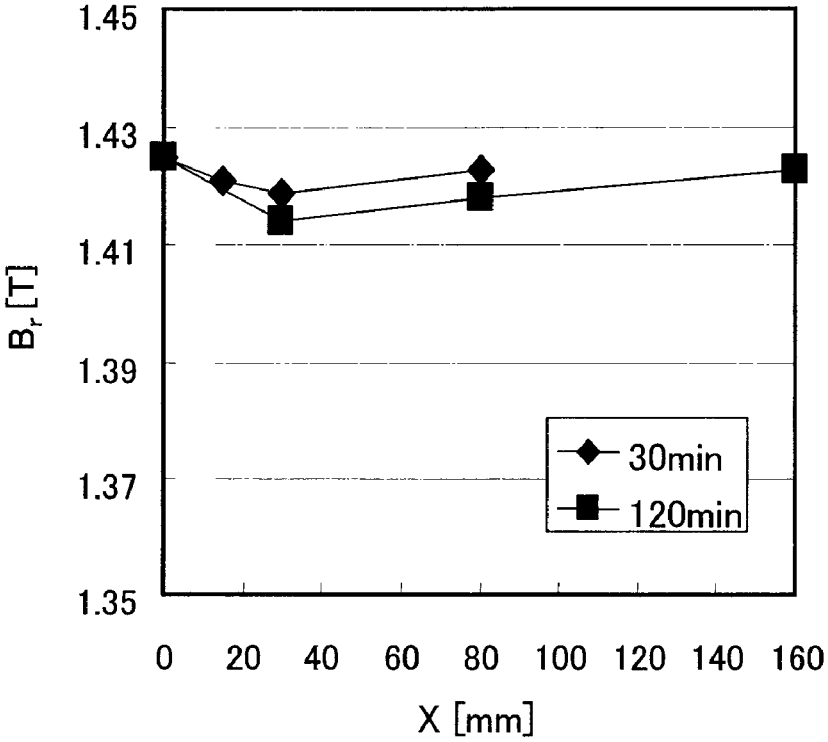
FIG. 15 is a set of graphs showing how the magnetic properties change with the distance from a magnet body to a Dy plate.
Figure 15:
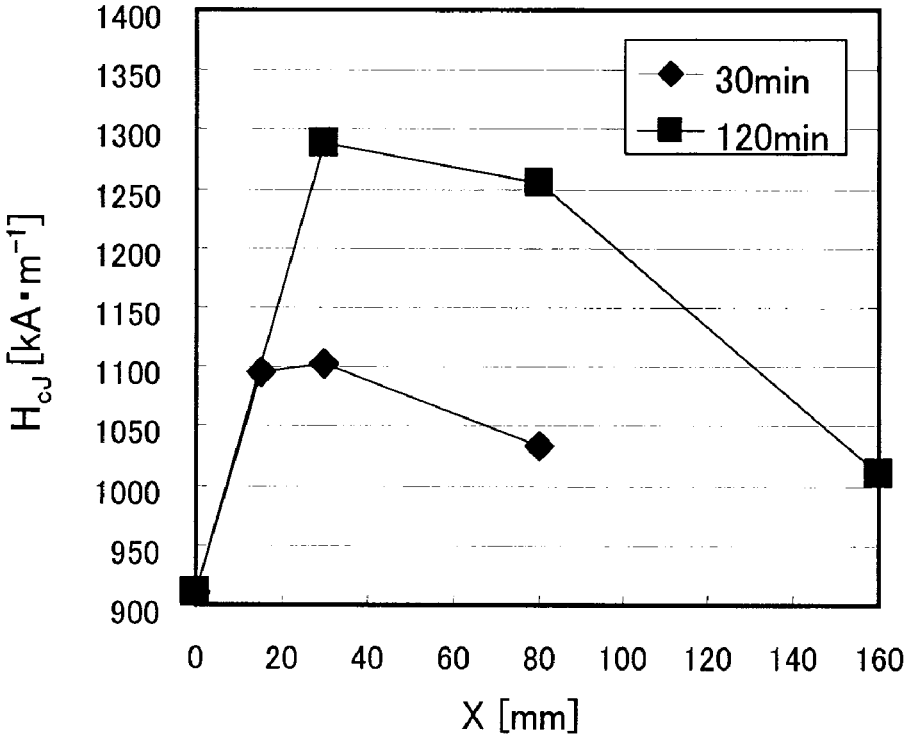

As can be seen from Table 7 and FIG. 15, the degree of increase in coercivity changed with the distance between the sintered magnet body and the Dy plate. When the distance was up to 30 mm, the degrees of increase were not so much different. However, the greater the distance, the smaller the degree of increase. Nevertheless, even if the distance is 30 mm or more, the coercivity can also be increased by extending the heat treatment process time.

TABLE 7

| | $B_r$ [T] | $H_{cJ}$ [kA/m] |
|---|---|---|
| Original material | 1.42 | 911 |
| ① | 1.42 | 1,096 |
| ② | 1.42 | 1,102 |
| ③ | 1.42 | 1,033 |
| ④ | 1.41 | 1,289 |
| ⑤ | 1.42 | 1,255 |
| ⑥ | 1.42 | 1,010 |

Example 6

Figure 16:
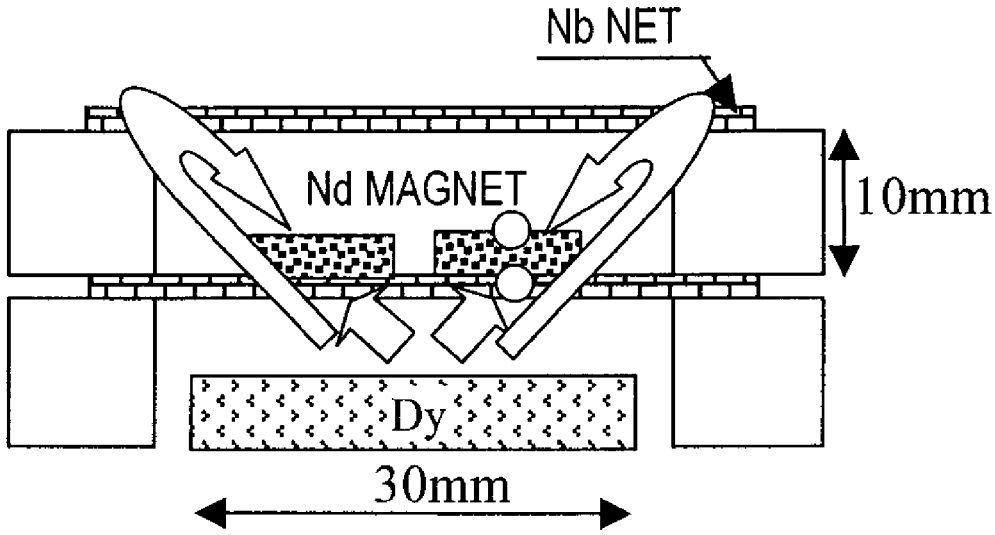
FIG. 16 is a cross-sectional view illustrating an arrangement of a Dy plate and sintered magnet bodies.

Sintered magnet bodies that had been made by the same method as that described for the first example and a Dy plate with dimensions of 30 mm×30 mm×5 mm and a purity of 99.9% were arranged as shown in FIG. 16 and subjected to a heat treatment at 900° C. and at $1\times10^{-2}$ Pa in a vacuum heat treatment furnace. In this example, the heat treatment was carried out with two Dy plates arranged over and under the sintered magnet bodies, respectively, with a single Dy plate arranged only over the sintered magnet bodies and with a single Dy plate arranged only under the sintered magnet bodies. The sintered magnet bodies had dimensions of 7 mm×7 mm×3 mm (the last one is the thickness defining the magnetization direction) and had been acid-cleaned with a 0.3% nitric acid and dried.

Figure 17:
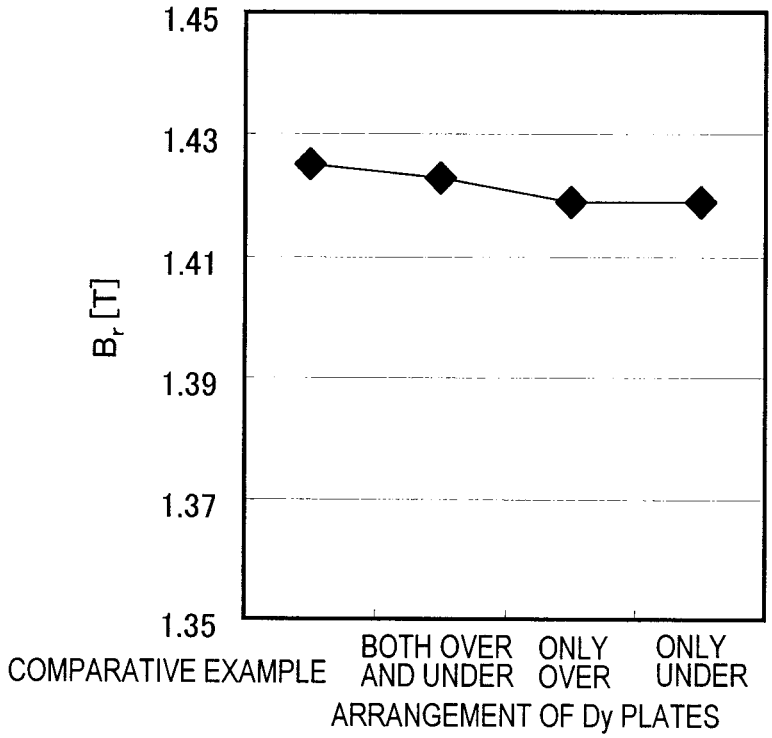
FIG. 17 is a set of graphs showing how the magnetic properties change with the arrangement of Dy plates.
Figure 17:
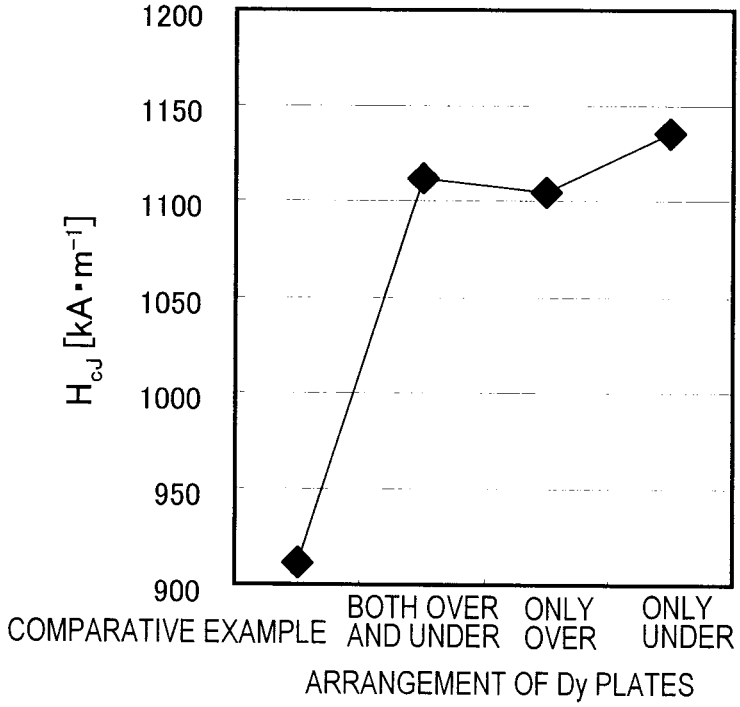

Thereafter, these sintered magnet bodies were further subjected to an aging treatment at 500° C. for 60 minutes at a degree of vacuum of 2 Pa, and then the properties of the magnet (including the remanence $B_r$ and coercivity $H_{cJ}$) were measured with a B-H tracer. FIG. 17 shows the magnetic properties thus measured.

As shown in FIG. 17, no matter where the Dy plate(s) was/were arranged, the coercivity always increased. This is probably because the vaporized Dy particles would have been present uniformly in the vicinity of the surface of the sintered magnet bodies during the vacuum heat treatment.

Figure 18:
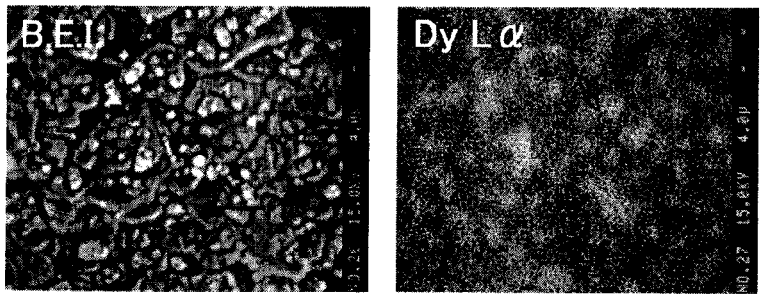
FIG. 18 is a set of photographs showing the results of an EPMA analysis that was carried out on the surface of a thermally treated sintered magnet body when a Dy plate was arranged only under the sintered magnet body, wherein FIG. 18(*a*) is a pair of photographs showing the results of analysis on the center of the upper surface of the sintered magnet body and FIG. 18(*b*) is a pair of photographs showing the results of analysis on the center of the lower surface of the sintered magnet body.
Figure 18:
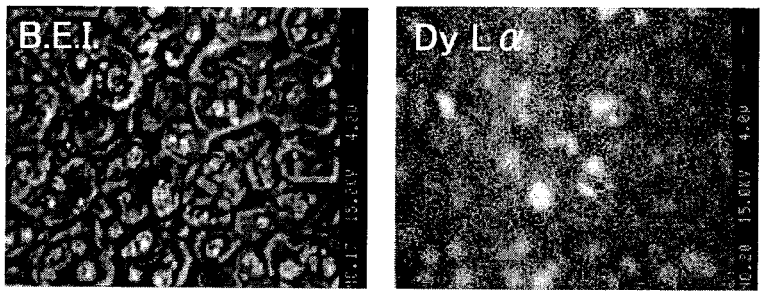

FIG. 18 shows the results of an EPMA analysis that was carried out on the surface of the thermally treated sintered magnet body when the Dy plate was arranged only under the sintered magnet body. Specifically, FIG. 18(*a*) shows the results of analysis on the center of the upper surface of the sintered magnet body and FIG. 18(*b*) shows the results of analysis on the center of the lower surface of the sintered magnet body. It can be seen that Dy had evaporated and diffused in almost the same way at the respective centers of the upper and lower surfaces of the sintered magnet body. This means that the vaporized Dy particles were distributed uniformly near the surfaces of the sintered magnet body.

Example 7

Figure 19:
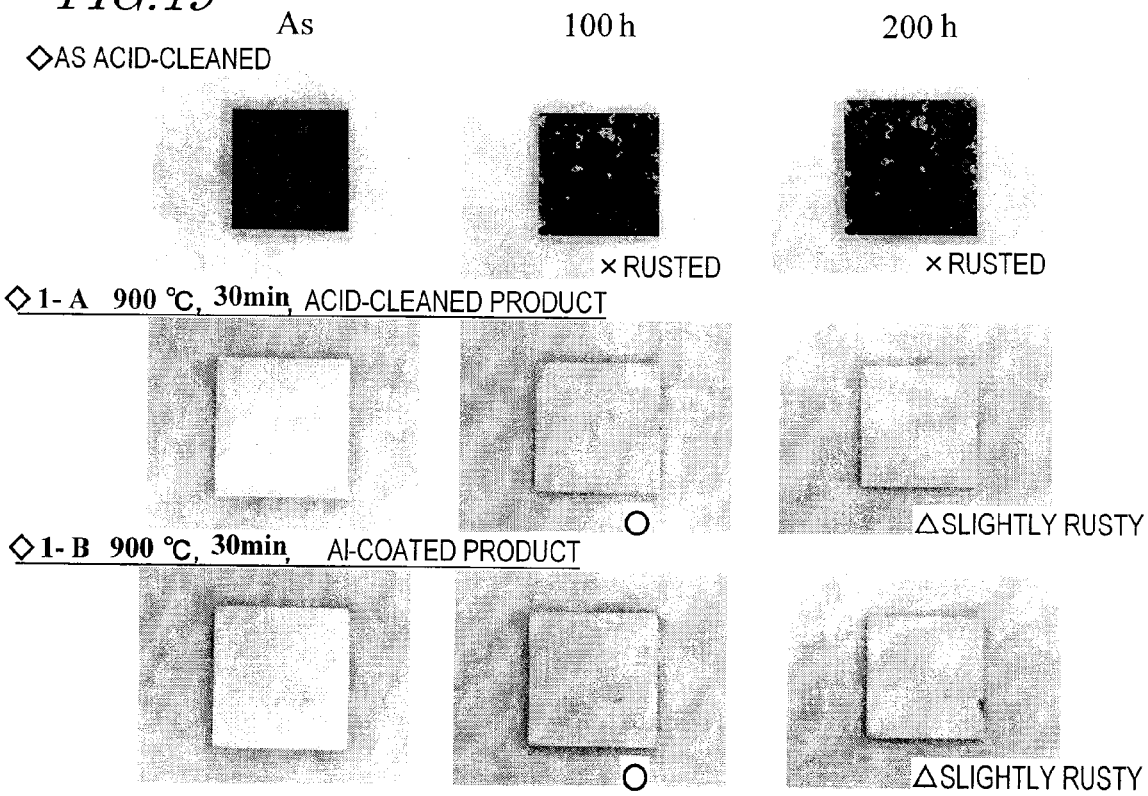
FIG. 19 is a set of photographs showing a seventh specific example of the present invention.

A non-wetting test was carried out at 80° C. and with 90% RH on samples that had been subjected to the evaporation diffusion process under the condition X (900° C. and 30 minutes) of the first example. FIG. 19 is a set of photographs showing how rusty the surface of the magnet body got after the non-wetting test. In FIG. 19, "as acid-cleaned" refers to a sintered magnet body that was acid-cleaned with a 0.3% nitric acid, dried and then subjected to an aging treatment at a pressure of 2 Pa and at a temperature of 500° C. for 60 minutes without being subjected to the evaporation diffusion process. "1-A" refers to a sintered magnet body that was acid-cleaned under the same conditions as the "as acid-cleaned" sintered magnet body and then subjected to the evaporation diffusion process and the aging treatment under the condition X of the first example described above. "1-B" refers to a sintered magnet body that was acid-cleaned under the same conditions as the "as acid-cleaned" sintered magnet body, coated with Al under the same conditions as those described for the first example, and then subjected to the evaporation diffusion process and the aging treatment under the condition X of the first example described above. As can be seen from FIG. 19, compared to the "as acid-cleaned" sample, the non-wettability increased in both "1-A" and "1-B" samples. This should be because by performing the diffusion process of the present invention, a dense mixed phase structure of Dy or Nd is formed and the uniformity of the potential increases, thus preventing corrosion due to a potential difference from advancing rapidly.

Example 8

Figure 20:
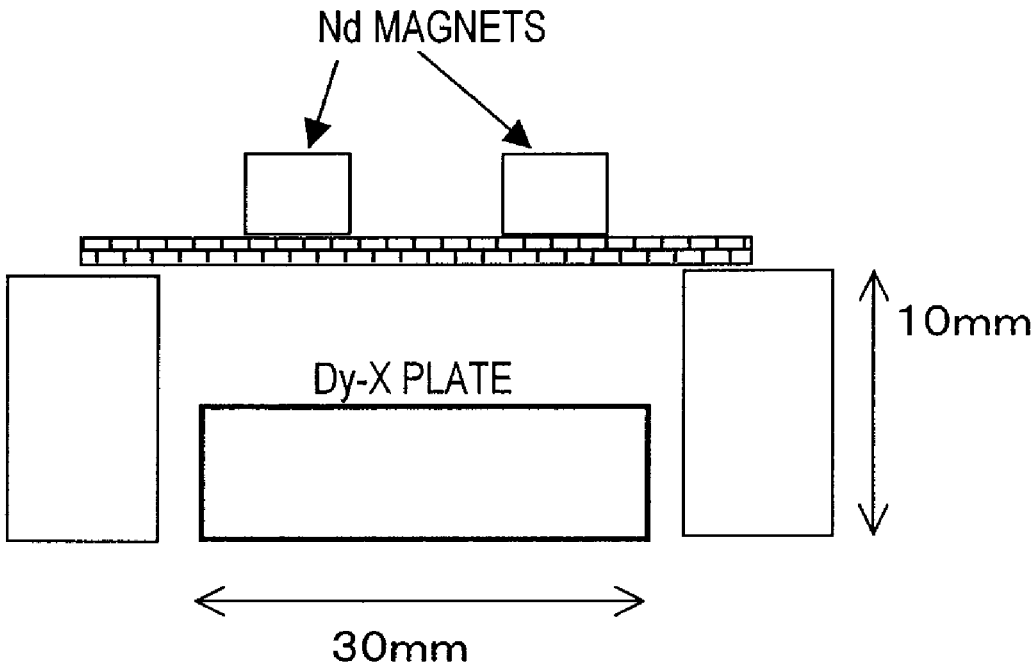
FIG. 20 is a cross-sectional view showing an arrangement of a Dy—X plate and sintered magnet bodies in a process vessel that was used in a manufacturing process of an eighth specific example of the present invention.

An Nd sintered magnet that was produced under the conditions of the first example so as to have a composition consisting of 31.8 mass % of Nd, 0.97 mass % of B, 0.92 mass % of Co, 0.1 mass % of Cu, 0.24 mass % of Al, 0 mass % of Dy, and Fe as the balance was machined and cut into a number of workpieces with dimensions of 10 mm×10 mm×3 mm (the last one is the magnetization direction). Those workpieces are arranged as shown in FIG. 20, thermally treated for 120 minutes at a temperature of 900° C. and at a pressure of $1\times10^{-2}$ Pa and then subjected to an aging treatment for 120 minutes at a temperature of 500° C. and at a pressure of 2 Pa. The compositions of several Dy—X alloys are shown in the following Table 8:

TABLE 8

| | Dy | X | Dy | X |
|---|---|---|---|---|
| | mass % | | at % | |
| Dy | 100 | 0 | 100 | 0 |
| Dy—Nd | 50 | 50 | 47 | 53 |
| Dy—Al | 25 | 75 | 67 | 33 |
| Dy—Fe | 88 | 12 | 72 | 28 |
| Dy—In | 85 | 15 | 80 | 20 |

As Dy—Nd is an alloy, 100% of which forms a solid solution, Dy and Nd had a ratio of 50 mass % to 50 mass % in their composition. As for the other alloys, ratios that would make Dy and X form a eutectic compound were selected.

Figure 21:
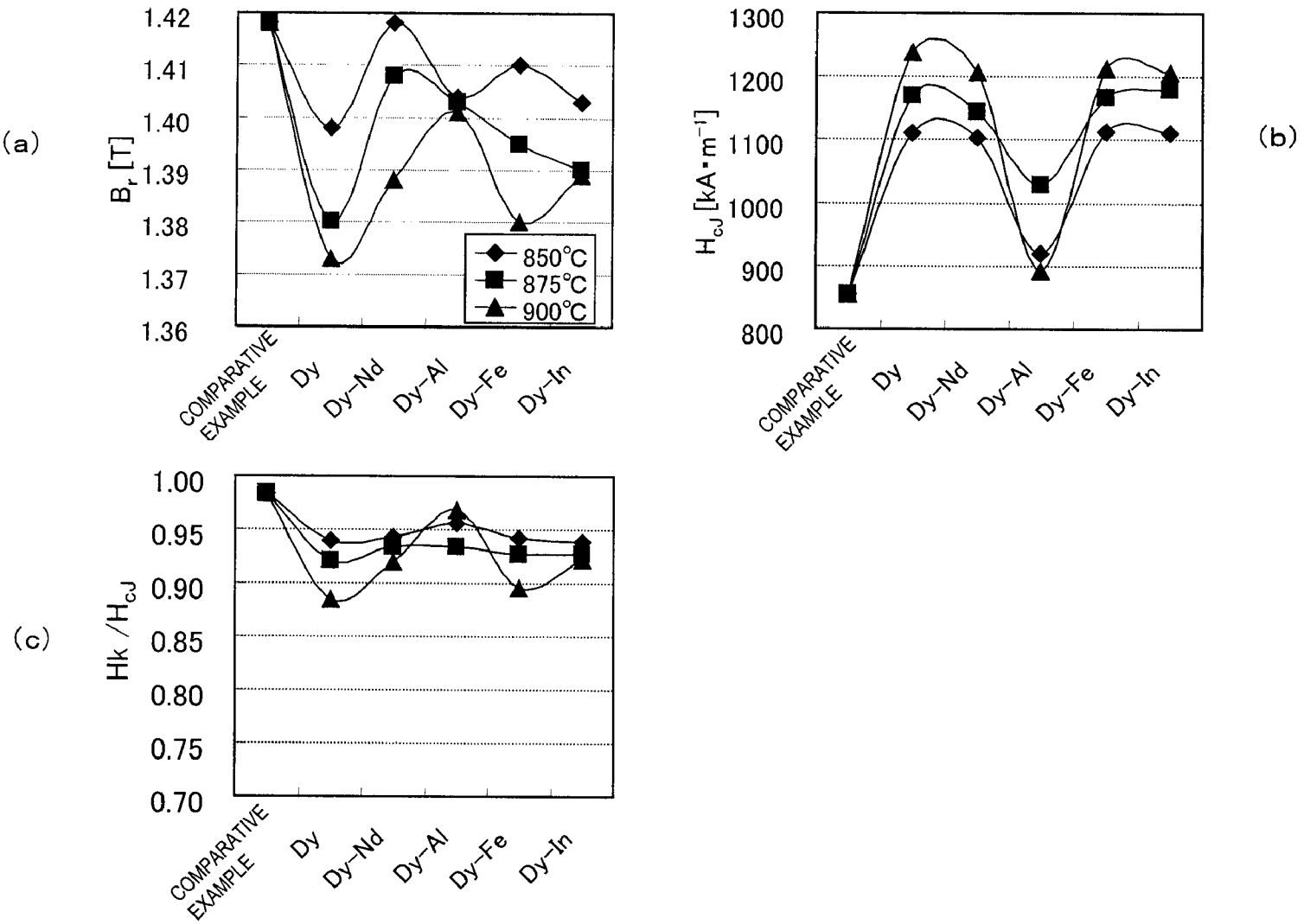
FIGS. 21(*a*), 21(*b*) and 21(*c*) are graphs respectively showing the remanences $B_r$, coercivities $H_{cJ}$ and loop squareness ($H_k/H_{cJ}$) of sample magnets that were made by the method of the present invention.

The magnetic properties of these samples (including the remanence $B_r$ and coercivity $H_{cJ}$) before and after the evaporation and diffusion process were measured with a B-H tracer. FIGS. 21(*a*), 21(*b*) and 21(*c*) are graphs showing the remanence $B_r$, coercivity $H_{cJ}$ and loop squareness ($H_k/H_{cJ}$), respectively.

As can be seen from the graph shown in FIG. 21(*b*), the coercivity $H_{cJ}$ increased in all of the samples. This is because the diffusion of Dy into the sintered magnet body would have formed a layer with a high Dy concentration and with high anisotropic magnetic field on the outer periphery of the main phase (i.e., $Nd_2Fe_{14}B$ crystals). As for Dy—X other than Dy—Al, the coercivity increased to almost the same degree compared to Dy alone, but decreases in remanence and loop squareness ($H_k/H_{cJ}$) could be minimized. This is presumably because the evaporation and diffusion of not just Dy but also the element X would have lowered the melting point of the grain boundary phase and further promoted the diffusion of Dy. This effect was achieved remarkably when the element X included Nd. The reason would be that as the bulk body supplied Nd to the sintered magnet body, Nd would have compensated for the very small amount of rare-earth element such as Nd or Pr that had vaporized from the grain boundary phase of the sintered magnet body during the heat treatment.

The present inventors confirmed, by the same method as that described above, that similar effects were achieved by various elements (including La, Ce, Cu, Co, Ag, Zn and Sn) other than the elements X shown in Table 8.

Example 9

Figure 22:
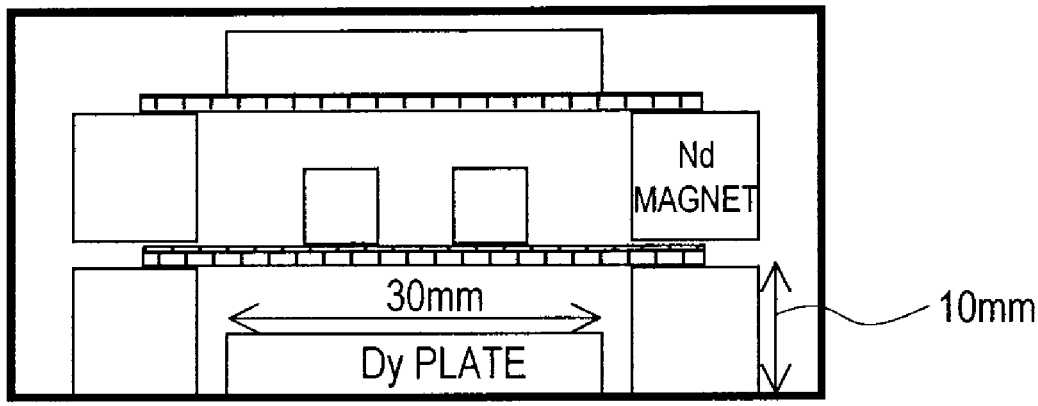
FIG. 22(*a*) shows an arrangement of sintered magnet bodies and a Dy plate and FIG. 22(*b*) shows the crystallographic orientations of a sintered magnet body.
Figure 22:
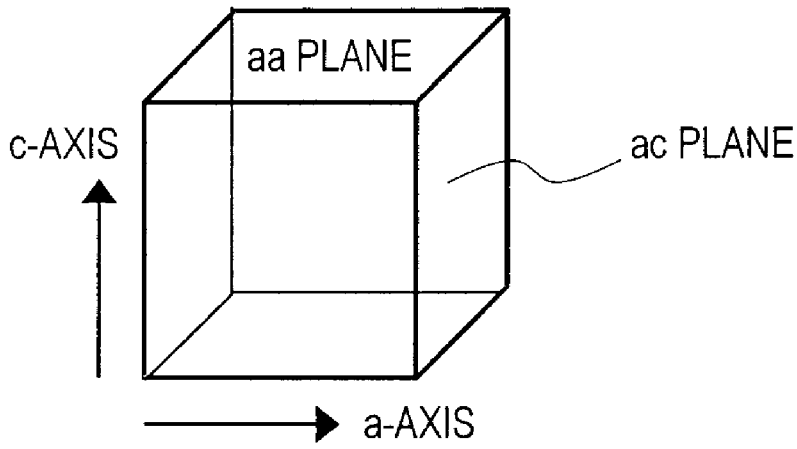

A sintered magnet body that was produced by the same method as that already described for the first example was machined and cut into a number of sintered magnet bodies with dimensions of 6 mm (in the magnetization direction)×6 mm×6 mm. These sintered magnet bodies and Dy plates were arranged as shown in FIG. 22(*a*). Specifically, the Dy plates were arranged over and under the sintered magnet bodies such that the magnetization direction of the sintered magnet bodies became substantially perpendicular to the opposing surfaces of the upper and lower Dy plates. The sintered magnet bodies in such an arrangement were subjected to a heat treatment for 120, 240 and 600 minutes, respectively, at a temperature of 900° C. and at a pressure of $1\times10^{-2}$ Pa in a vacuum heat treatment furnace and then subjected to an aging treatment for 120 minutes at a temperature of 500° C. and at a pressure of 2 Pa.

FIG. 22(*b*) shows the crystallographic orientations of the sintered magnet body. In FIG. 22(*b*), a plane of the cubic sintered magnet body that intersects with the c-axis (defining the magnetization direction) at right angles is labeled as "aa plane" and another plane of the sintered magnet body that does not intersect with the c-axis at right angles as "ac plane".

During the heat treatment described above, only the two "aa planes" out of the six planes of the sintered magnet body were exposed in sample aa2 and the other four planes thereof were covered with Nb foil with a thickness of 0.05 mm. In the same way, in sample ac2, only the two "ac planes" were exposed and the other four planes thereof were covered with Nb foil with a thickness of 0.05 mm.

The magnetic properties of the samples (including the remanence $B_r$ and coercivity $H_{cJ}$) before and after the heat treatment were measured with a B-H tracer.

Figure 23:
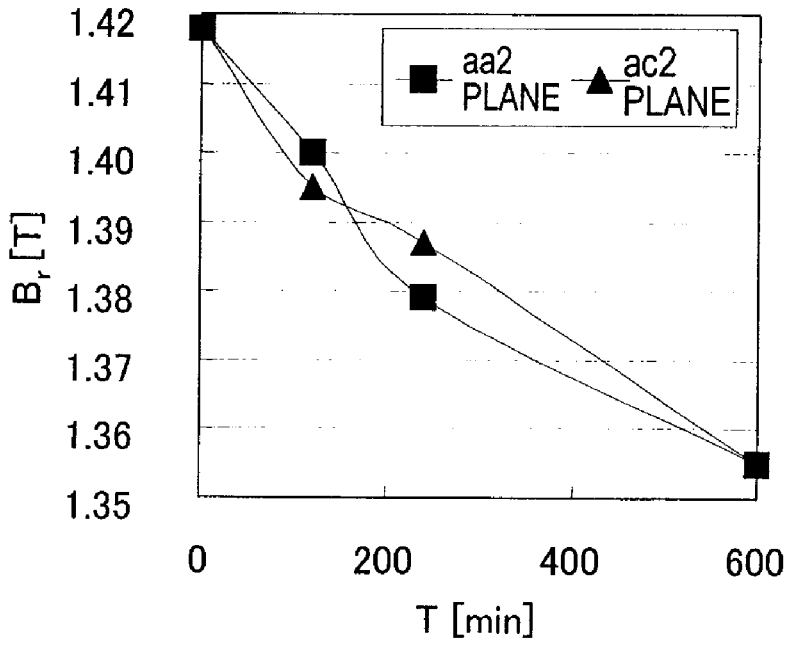
FIGS. 23(*a*) and 23(*b*) are graphs showing the remanence $B_r$ and coercivity $H_{cJ}$ that were measured on a ninth specific example of the present invention.
Figure 23:
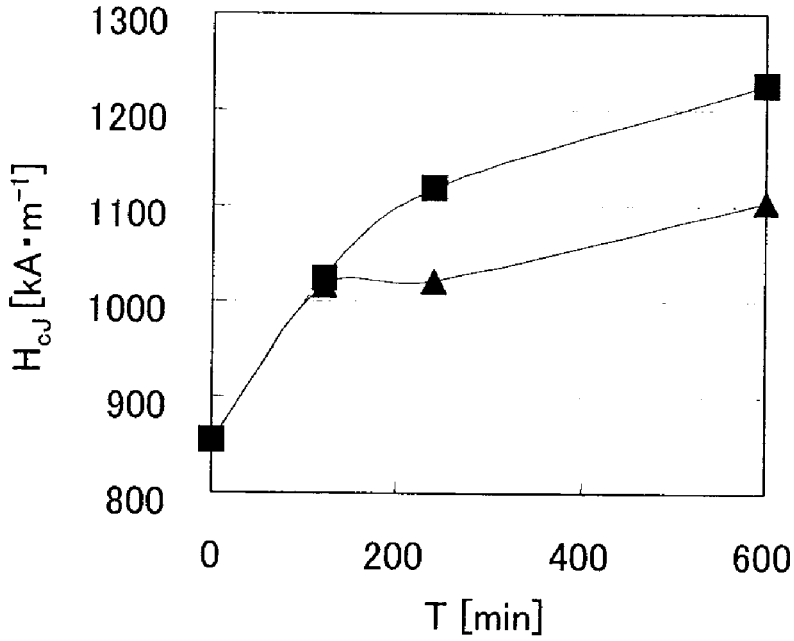

FIG. 23 is a graph showing how much the coercivity $H_{cJ}$ increased and how much the remanence $B_r$ decreased. Once the heat treatment process time exceeded 240 minutes, the remanences $B_r$ of the samples aa and ac decreased to almost the same degree but the coercivity $H_{cJ}$ of the sample aa increased approximately 100 kA/m more than that of the sample ac.

Next, to estimate the diffusion distances of Dy, the samples aa2 and ac2 that had been thermally treated for 240 minutes had their magnetic properties measured with a B-H tracer every time the samples were machined 0.2 mm as measured from the surface.

Figure 24:
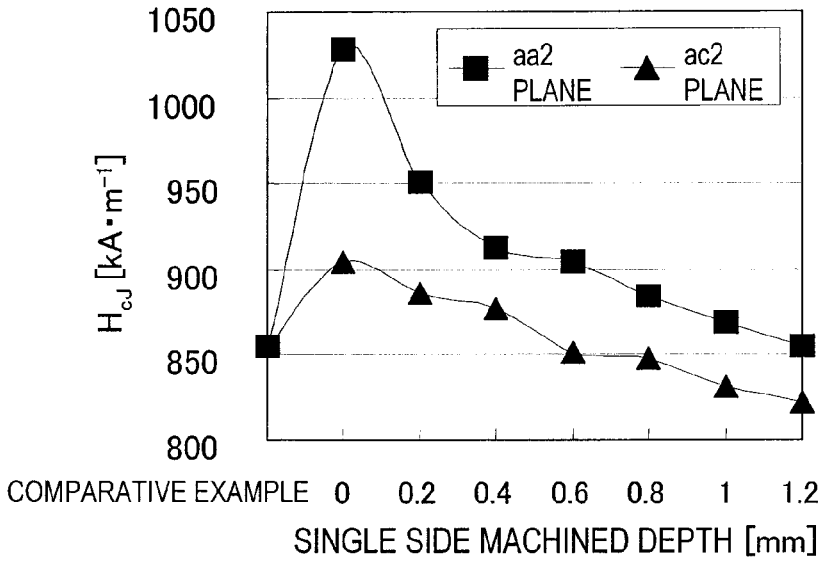
FIG. 24 is a graph showing how the coercivity $H_{cJ}$ changes with the machined depth in the ninth specific example.

FIG. 24 is a graph showing the coercivities $H_{cJ}$ that were measured in this manner. In the sample ac2, when the machined depth reached approximately 0.6 mm in total, the coercivity $H_{cJ}$ became approximately equal to the value before the heat treatment. On the other hand, in the sample aa, when the machined depth reached approximately 1.2 mm in total, the coercivity $H_{cJ}$ became approximately equal to the value before the heat treatment. As can be seen easily from these results, the diffusion rate in the c-axis direction (i.e., the magnetic field alignment direction) is almost twice as high as the diffusion rate in the direction that is perpendicular to the c-axis.

Example 10

Figure 25:
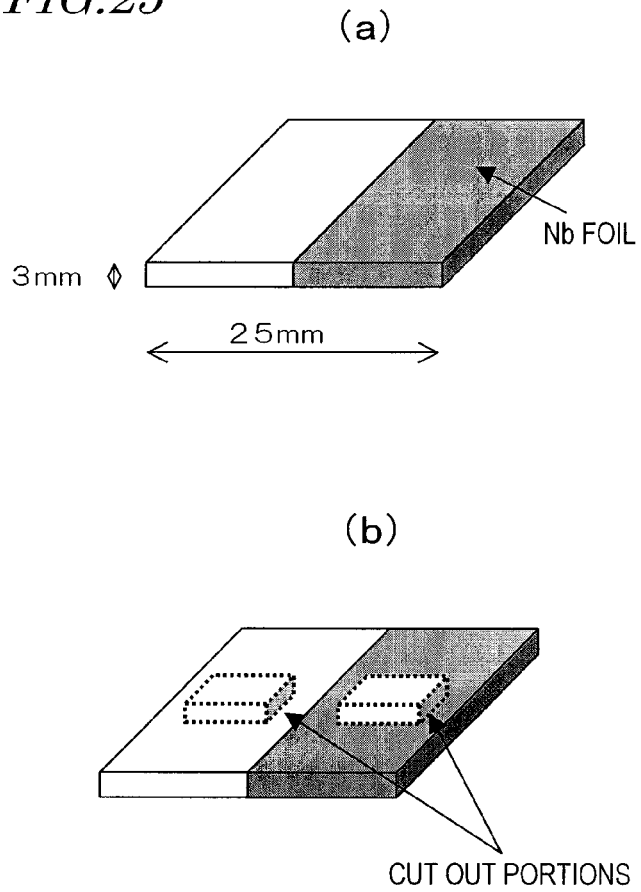
FIGS. 25(*a*) and 25(*b*) are perspective views showing which surface portion of a sintered magnet body was covered with Nb foil in a tenth specific example of the present invention.

A sintered magnet body that was produced by the same method as that already described for the first example so as to have a thickness of 3 mm (in the magnetization direction), a length of 25 mm and a width of 25 mm had approximately 50% of its surface covered with Nb foil as shown in FIG. 25(*a*). Next, the sintered magnet body was arranged as shown in FIG. 1, thermally treated for 120 minutes at a temperature of 900° C. and at a pressure of $1\times10^{-2}$ Pa in a vacuum heat treatment furnace, and then subjected to an aging treatment for 120 minutes at a temperature of 500° C. and at a pressure of 2 Pa. After the heat treatment, very little Dy was deposited on the Nb foil and could be easily removed without reacting to, and fusing with, the sintered magnet body.

From this thermally treated sample, portions with a thickness of 3 mm (in the magnetization direction), a length of 7 mm and a width of 7 mm were cut out with a diamond cutter at the regions shown in FIG. 25(*b*). Then, the magnetic properties (including the remanence $B_r$ and coercivity $H_{cJ}$) of the portion in which Dy was allowed to diffuse and penetrate (Sample E) and the portion wrapped in the Nb foil (Sample F) were measured with a B-H tracer.

The results of the measurements are shown in the following Table 9. The present inventors confirmed that the coercivity $H_{cJ}$ increased in the portion that was not wrapped in the Nb foil but where Dy was allowed to diffuse and penetrate compared to the portion that was wrapped in the Nb foil. Thus, according to this example, by selectively diffusing Dy in a particular portion of a sintered magnet body, the magnetic properties of that portion can be made different from those of the other portions.

TABLE 9

| Sample | $B_r$ [T] | $H_{cJ}$ [kA/m] |
|---|---|---|
| E | 1.40 | 1,254 |
| F | 1.42 | 870 |

Example 11

Using alloy ingots that had been prepared so as to have the five different compositions shown in the following Table 10, thin alloy flakes with thicknesses of 0.2 mm to 0.3 mm were made by a strip casting process.

Next, a container was loaded with these thin alloy flakes and then introduced into a hydrogen pulverizer, which was filled with a hydrogen gas atmosphere at a pressure of 500 kPa. In this manner, hydrogen was occluded into the thin alloy flakes at room temperature and then released. By performing such a hydrogen process, the alloy flakes were decrepitated to obtain a powder in indefinite shapes with sizes of about 0.15 mm to about 0.2 mm.

Thereafter, 0.05 wt % of zinc stearate was added as a pulverization aid to the coarsely pulverized powder obtained by the hydrogen process and then the mixture was pulverized with a jet mill to obtain a fine powder with a particle size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at 1,020° C. for four hours in a vacuum furnace, thus obtaining sintered blocks, which were then machined and cut into sintered magnet bodies with the dimensions shown in the following Table 11:

TABLE 10

| Composition | Nd | Dy | Fe | B | Co | Cu | Al |
|---|---|---|---|---|---|---|---|
| L | 32.0 | 0 | balance | 1.0 | 0.9 | 0.1 | 0.2 |
| M | 29.5 | 2.5 | | | | | |
| N | 27.0 | 5.0 | | | | | |
| O | 24.5 | 7.5 | | | | | |
| P | 22.0 | 10.0 | | | | | |

(unit: mass %)

TABLE 11

| Condition | Evaporation diffusion condition | Process time | Dimensions of magnet (thickness/length/width) |
|---|---|---|---|
| α | $1\times10^{-2}$ Pa | 120 min. | 3 mm × 7 mm × 7 mm |
| β | 900° C. | | 6 mm × 7 mm × 7 mm |
| γ | | 240 min | 3 mm × 7 mm × 7 mm |
| δ | | | 6 mm × 7 mm × 7 mm |

These sintered magnet bodies were acid-cleaned with a 0.3% nitric acid aqueous solution, dried, and then arranged in a process vessel with the configuration shown in FIG. 1. The process vessel for use in this preferred embodiment was made of Mo and included a member for holding a plurality of sintered magnet bodies and a member for holding two RH bulk bodies. A gap of about 5 mm to about 9 mm was left between the sintered magnet bodies and the RH bulk bodies. The RH bulk bodies were made of Dy with a purity of 99.9% and had dimensions of 30 mm×30 mm×5 mm.

Next, the process vessel shown in FIG. 1 was heated in a vacuum heat treatment furnace to conduct a heat treatment to trigger evaporation and diffusion. The conditions for the heat treatment are as shown in Table 11. It should be noted that the "heat treatment temperature" will mean herein the temperature of the sintered magnet bodies and that of the RH bulk bodies, which is approximately equal to that of the sintered magnet bodies, unless otherwise stated.

After the evaporation diffusion process was carried out under the conditions shown in Table 11, an aging treatment was performed for 60 minutes at a pressure of 2 Pa and at a temperature of 500° C.

Before the evaporation diffusion process and after the aging treatment, each sample was magnetized with pulses with an intensity of 3 MA/m and then the properties of the magnet (including its remanence $B_r$ and coercivity $H_{cJ}$) were measured with a B-H tracer. Also, based on the results of this measurement, variations in coercivity $H_{cJ}$ and remanence $B_r$, caused by the evaporation diffusion process (aging treatment), were calculated with respect to the coercivity $H_{cJ}$ and remanence $B_r$ of each sample yet to be subjected to the evaporation diffusion process.

Figure 26:
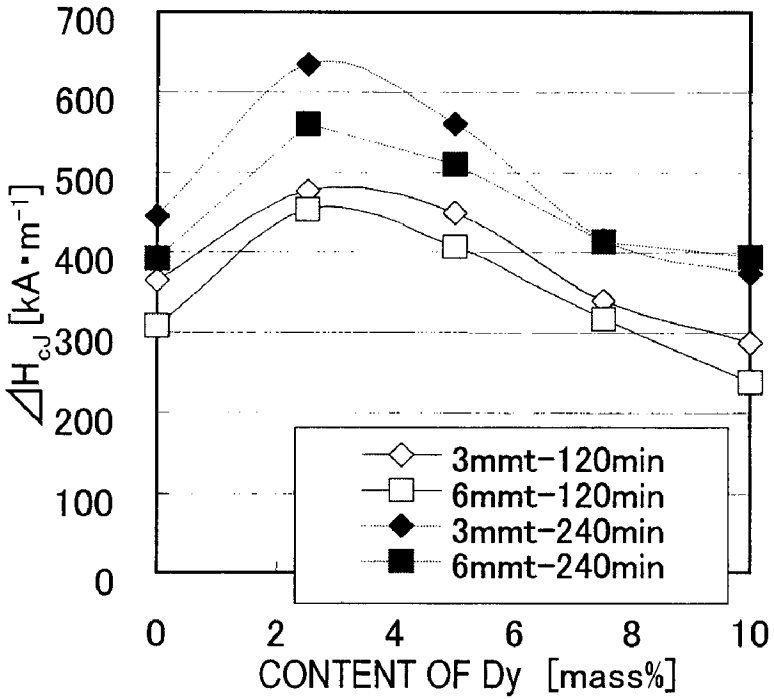
FIGS. 26(*a*) and 26(*b*) are graphs respectively showing variations $\Delta H_{cJ}$ in the coercivity and variations $\Delta B_r$ in the remanence of magnets with compositions L through P as measured with a B-H tracer.
Figure 26:
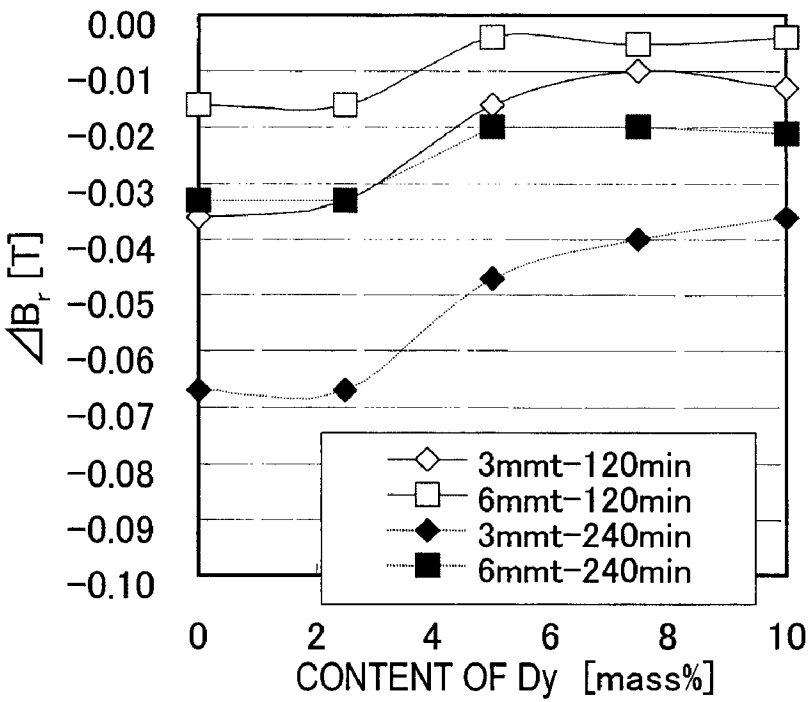

FIG. 26(*a*) is a graph showing the variations $\Delta H_{cJ}$ in the coercivity of the sintered magnet bodies with the compositions L through P. In FIG. 26(*a*), the data points ◇, □, ◆ and ■ represent the variations $\Delta H_{cJ}$ in the coercivity of the samples that were subjected to the evaporation diffusion process under the conditions α, β, γ and δ, respectively, shown in Table 11.

On the other hand, FIG. 26(*b*) is a graph showing the variations $\Delta B_r$ in the remanence of the sintered magnet bodies with the compositions L through P. In FIG. 26(*b*), the data points ◇, □, ◆ and ■ represent the variations $\Delta B_r$ in the remanence of the samples that were subjected to the evaporation diffusion process under the conditions α, β, γ and δ, respectively, shown in Table 11.

As can be seen easily from FIGS. 26(*a*) and 26(*b*), the sintered magnet with composition B (including 2.5% of Dy) achieved the highest coercivity $H_{cJ}$ with the decrease in remanence $B_r$ minimized.

The samples yet to be subjected to the evaporation diffusion process shown in Table 11 and the samples that had been subjected to the evaporation diffusion process (and the aging treatment) had their cross sections polished and then subjected to a ZAF analysis using an EPMA EPM-1610 (produced by Shimadzu Corporation). The following Table 12 shows the concentrations of Dy (mass %) at the centers of the main phases and at the grain boundary triple junctions:

TABLE 12

| | | Composition L with 0% of Dy | Composition M with 2.5% of Dy | Composition N with 5.0% of Dy |
|---|---|---|---|---|
| Before evaporation diffusion | main phase | 0 | 2.8 | 5.4 |
| | Grain boundary phase | 0 | 5.5 | 8.2 |
| After evaporation diffusion | main phase | 5.9 | 7.8 | 9.6 |
| | Grain boundary phase | 16.2 | 27.5 | 29.0 |
| Variation | main phase | 5.9 | 5.0 | 4.2 |
| | Grain boundary phase | 16.2 | 22.0 | 20.8 |

Good magnetic properties were achieved by the sample with the composition M presumably because the sample with the composition M could produce the diffusion of Dy toward the grain boundary phase most efficiently as can be seen easily from Table 12.

Example 12

An alloy ingot was prepared by a strip casting process so as to have a composition consisting of 31.8 mass % of Nd, 0.97 mass % of B, 0.92 mass % of Co, 0.1 mass % of Cu, 0.24 mass % of Al and Fe as the balance, thereby making thin alloy flakes with thicknesses of 0.2 mm to 0.3 mm.

Next, a container was loaded with these thin alloy flakes and then introduced into a hydrogen pulverizer, which was filled with a hydrogen gas atmosphere at a pressure of 500 kPa. In this manner, hydrogen was occluded into the thin alloy flakes at room temperature and then released. By performing such a hydrogen process, the thin alloy flakes were decrepitated to obtain a powder in indefinite shapes with sizes of about 0.15 mm to about 0.2 mm.

Thereafter, 0.05 wt % of zinc stearate was added as a pulverization aid to the coarsely pulverized powder obtained by the hydrogen process and then the mixture was pulverized with a jet mill to obtain a fine powder with a particle size of approximately 3 μm.

The fine powder thus obtained was compacted with a press machine to make a powder compact with dimensions of 20 mm×10 mm×5 mm (the last one is as measured in the direction of magnetic field). More specifically, the powder particles were pressed and compacted while being aligned with a magnetic field applied. Thereafter, the powder compact was unloaded from the press machine and then arranged in a process vessel with the configuration shown in FIG. 1. The process vessel for use in this preferred embodiment was made of Mo and included a member for holding a plurality of compacts and a member for holding two RH bulk bodies. A gap of about 5 mm to about 9 mm was left between the compacts and the RH bulk bodies. The RH bulk bodies were made of a Dy plate with a purity of 99.9% and had dimensions of 30 mm×30 mm×5 mm.

This process vessel was loaded into a vacuum furnace and subjected to a sintering process and a diffusion process under the conditions shown in the following Table 13, which shows the conditions of the sintering and diffusion processes for twelve samples 1-A through 6-B. In Table 13, samples "A" represent examples in which the powder compacts are arranged along with Dy plates as shown in FIG. 1 and subjected to the heat treatment, while samples "B" represent comparative examples in which the powder compacts were subjected to the heat treatment under the same conditions with no Dy plates arranged. Each of these samples was subjected to an aging treatment for 120 minutes at a temperature of 500° C. and at a pressure of 2 Pa after the diffusion process.

TABLE 13

| Temperature Degree of | Sintering process 1,040° C. | | | Heat treatment process 900° C. |
|---|---|---|---|---|
| vacuum | $10^3$ Pa | 150 Pa | $1 \times 10^{-2}$ Pa | $1 \times 10^{-2}$ Pa |
| 1-A | — | 180 min. | — | 120 min (with diffusion) |
| 1-B | | | | 120 min. (with no diffusion) |
| 2-A | — | 120 min. | 60 min. | 60 min (with diffusion) |
| 2-B | | | | 60 min. (with no diffusion) |
| 3-A | — | 90 min. | 90 min. | 30 min (with diffusion) |
| 3-B | | | | 30 min. (with no diffusion) |
| 4-A | 180 min. | — | — | 120 min (with diffusion) |
| 4-B | | | | 120 min. (with no diffusion) |
| 5-A | 120 min. | — | 60 min. | 60 min (with diffusion) |
| 5-B | | | | 60 min. (with no diffusion) |
| 6-A | 90 min. | — | 90 min. | 30 min (with |

TABLE 13-continued

| Temperature Degree of vacuum | Sintering process 1,040° C. $10^3$ Pa | 150 Pa | $1 \times 10^{-2}$ Pa | Heat treatment process 900° C. $1 \times 10^{-2}$ Pa |
|---|---|---|---|---|
| 6-B | | | | diffusion) 30 min. (with no diffusion) |

The resultant samples had their magnetic properties (including remanence $B_r$ and coercivity $H_{cJ}$) measured with a B-H tracer.

Figure 27:
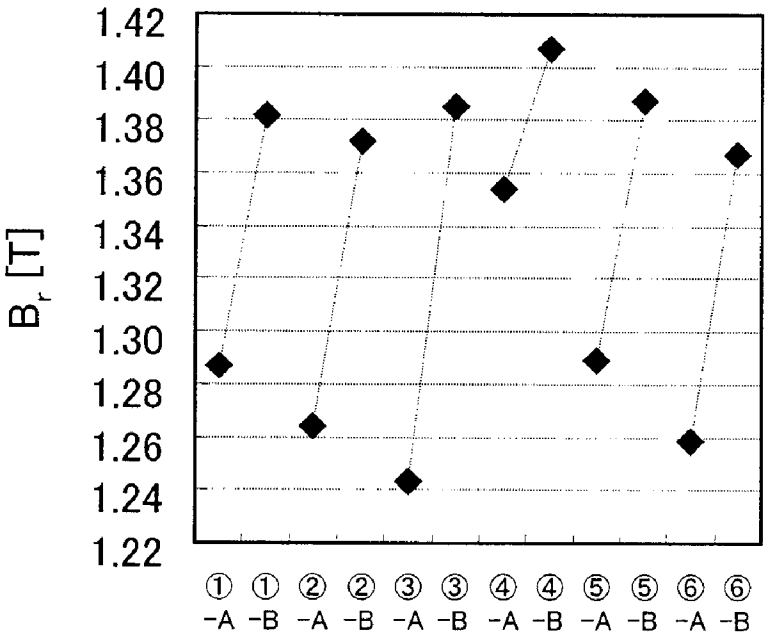
FIGS. 27(*a*) and 27(*b*) are graphs respectively showing the measured values of the remanences $B_r$ and coercivities $H_{cJ}$ of twelve samples.
Figure 27:
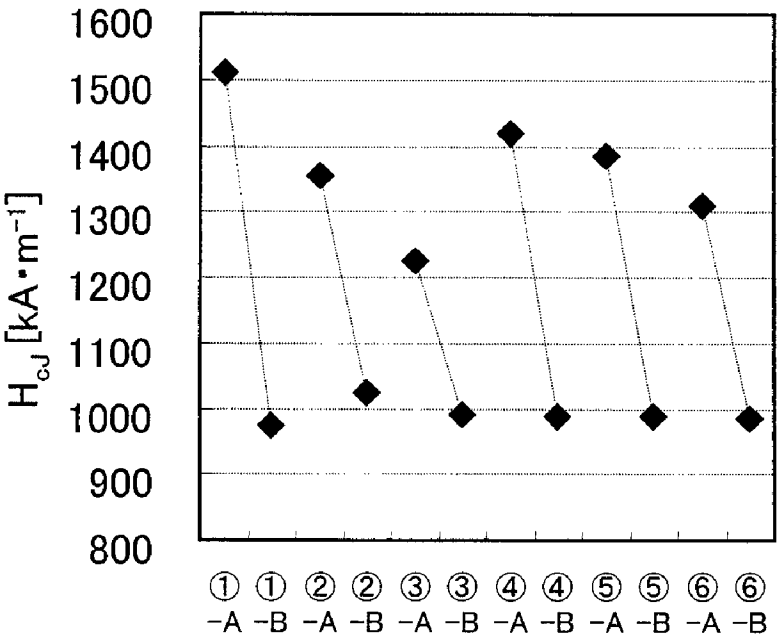

FIG. 27(*a*) is a graph showing the actually measured values of the remanences $B_r$ of these twelve samples and FIG. 27(*b*) is a graph showing the actually measured values of the coercivities $H_{cJ}$ of these twelve samples.

As can be seen from these graphs, in every specific example of the present invention (i.e., 1-A, 2-A, 3-A, 4-A, 5-A and 6-A), the coercivity $H_{cJ}$ was much higher than its associated comparative example (i.e., 1-B, 2-B, 3-B, 4-B, 5-B and 6-B). In Sample 4-A, in particular, the decrease in remanence $B_r$ was the smallest. This means that if the evaporation and diffusion of Dy are started after a sintering process has been performed at a relatively high atmospheric gas pressure, Dy can diffuse through the grain boundary phase most effectively and the coercivity $H_{cJ}$ can be increased efficiently.

Example 13

Using an alloy that was prepared so as to have a composition consisting of 32.0 mass % of Nd, 1.0 mass % of B, 0.9 mass % of Co, 0.1 mass % of Cu, 0.2 mass % of Al and Fe as the balance, a sintered magnet body was made as in the first example described above. Then, this sintered magnet body was cut into a number of workpieces with dimensions of 7 mm×7 mm×3 mm.

A heat treatment was conducted for 120 minutes at a temperature of 900° C. or 950° C. and at a pressure of $1\times10^{-3}$ Pa using Tb plates as the RH bulk bodies 4 in the arrangement shown in FIG. 1. Thereafter, an aging treatment was carried out for 120 minutes at a temperature of 500° C. and at a pressure of 2 Pa.

The magnetic properties (including the remanence $B_r$ and coercivity $H_{cJ}$) of the samples before and after the evaporation diffusion process were measured with a B-H tracer. As a result, the magnet body exhibited magnetic properties including a $B_r$ of 1.40 T and an $H_{cJ}$ of 850 kA/m before the evaporation diffusion process and exhibited magnetic properties including a $B_r$ of 1.40 T and an $H_{cJ}$ of 1,250 kA/m and a $B_r$ of 1.40 T and an $H_{cJ}$ of 1,311 kA/m, respectively, after the evaporation diffusion process.

Based on these results, the present inventors confirmed that by producing the evaporation and diffusion of Tb, the coercivity $H_{cJ}$ could be increased without decreasing the remanence $B_r$.

Example 14

Sintered magnets were made as samples as in the thirteenth example described above. Those sintered magnets were arranged as shown in FIG. 1 and then the evaporation and diffusion of Dy was produced from the RH bulk bodies 4 toward the sintered magnet bodies. Specifically, a heat treatment was conducted at a temperature of 900° C. and at a pressure of $1\times10^{-2}$ Pa for either 60 minutes or 120 minutes.

Some of the samples were subjected to the evaporation diffusion process and then to an aging treatment at a temperature of 500° C. and at a pressure of 2 Pa for 120 minutes. The other samples were subjected to a heat treatment for 120 minutes at a temperature of 900° C. and at a pressure of $1\times10^{-2}$ Pa with the RH bulk bodies 4 removed from the arrangement shown in FIG. 1 and then subjected to an aging treatment for 120 minutes at a temperature of 500° C. and at a pressure of 2 Pa. Thereafter, the magnetic properties of these samples were measured with a B-H tracer. The results are shown in the following Table 14:

TABLE 14

| | Evaporation diffusion process | With no additional heat treatment | | With additional heat treatment | |
|---|---|---|---|---|---|
| | time [min] | $B_r$ [T] | $H_{cJ}$ [kA/m] | $B_r$ [T] | $H_{cJ}$ [kA/m] |
| Original material | — | 1.40 | 850 | 1.40 | 870 |
| G | 60 | 1.39 | 1,150 | 1.39 | 1,250 |
| H | 120 | 1.39 | 1,220 | 1.39 | 1,370 |

The present inventors discovered that the coercivity $H_{cJ}$ could be further increased by conducting the additional heat treatment.

INDUSTRIAL APPLICABILITY

According to the present invention, main phase crystal grains, where a heavy rare-earth element RH is present at a high concentration on its outer periphery, can also be formed efficiently inside a sintered magnet body, too, thus providing a high-performance magnet having both high remanence and high coercivity alike.

The invention claimed is:

1. A method for producing an R—Fe—B based rare-earth sintered magnet, the method comprising the steps of:

(a) providing an R—Fe—B based rare-earth sintered magnet body including, as a main phase, crystal grains of an $R_2Fe_{14}B$ type compound that includes a light rare-earth element RL, which is at least one of Nd and Pr, as a major rare-earth element R;

(b) arranging a bulk body including a heavy rare-earth element RH, which is at least one element selected from the group consisting of Dy, Ho and Tb, along with the R—Fe—B based rare-earth sintered magnet body in a container; and (c) heating the container, by a heat treatment furnace in which the container is loaded, so that the bulk body and the R—Fe—B based rare-earth sintered magnet body arranged in the container are heated to a temperature of 700° C. to 1,000° C. to vaporize the heavy rare-earth element RH from the bulk body, thereby diffusing the heavy rare-earth element RH into the R—Fe—B based rare-earth sintered magnet body while supplying the heavy rare-earth element RH from the bulk body to the surface of the R—Fe—B based rare-earth sintered magnet body so that substantially no thin film made of the heavy rare-earth element RH is formed on the R—Fe—B based rare-earth sintered magnet body, wherein the step (c) includes arranging the bulk body and the R—Fe—B based rare-earth sintered magnet body out of contact with each other in the container and setting an average gap between the two bodies within the range of 0.1 mm to 300 mm, and wherein the step (c) includes setting a difference in temperature between the R—Fe—B based rare-earth sintered magnet body and the bulk body within 20° C.

2. The method of claim 1, wherein the step (c) includes adjusting the pressure of an atmospheric gas in the container within the range of $10^{-5}$ Pa to 500 Pa.

3. The method of claim 1, wherein the step (c) includes maintaining the temperatures of the bulk body and the R—Fe—B based rare-earth sintered magnet body within the range of 700° C. to 1,000° C. for 10 minutes to 600 minutes.

4. The method of claim 1, wherein the sintered magnet body includes 0.1 mass % to 5.0 mass % of a heavy rare-earth element RH, which is at least one element selected from the group consisting of Dy, Ho and Tb.

5. The method of claim 4, wherein the content of the heavy rare-earth element RH in the sintered magnet body is within the range of 1.5 mass % to 3.5 mass %.

6. The method of claim 1, wherein the bulk body includes an alloy of the heavy rare-earth element RH and an element X, which is at least one element selected from the group consisting of Nd, Pr, La, Ce, Al, Zn, Sn, Cu, Co, Fe, Ag and In.

7. The method of claim 6, wherein the element X is at least one of Nd and Pr.

8. The method of claim 1, further comprising the step of subjecting the R—Fe—B based rare-earth sintered magnet body to an additional heat treatment process after the step (c) has been performed.

9. A method for producing an R—Fe—B based rare-earth sintered magnet, the method comprising the steps of:

(A) arranging a compact of an R—Fe—B based rare-earth magnet powder, including a light rare-earth element RL (which is at least one of Nd and Pr) as a major rare-earth element R, in a processing chamber such that the compact faces a bulk body including a heavy rare-earth element RH, which is at least one element selected from the group consisting of Dy, Ho and Tb;

(B) performing a sintering process in the processing chamber, thereby making an R—Fe—B based rare-earth sintered magnet body including crystal grains of an $R_2Fe_{14}B$ type compound as a main phase; and (C) heating the bulk body and the R—Fe—B based rare-earth sintered magnet body in the processing chamber, thereby diffusing the heavy rare-earth element RH into the R—Fe—B based rare-earth sintered magnet body while supplying the heavy rare-earth element RH from the bulk body to the surface of the R—Fe—B based rare-earth sintered magnet body, wherein the step (B) includes performing the sintering process for 30 minutes to 600 minutes with a vacuum of 1 Pa to $10^5$ Pa created in the processing chamber and with an atmosphere in the processing chamber maintained at a temperature of 1,000° C. to 1,200° C., wherein the step (C) includes performing the heating process for 10 minutes to 600 minutes with a vacuum of $1\times10^{-5}$ Pa to 1 Pa created in the processing chamber and with an atmosphere in the processing chamber maintained at a temperature of 800° C. to 950° C., and wherein the step (C) includes arranging the bulk body and the R—Fe—B based rare-earth sintered magnet body out of contact with each other in the processing chamber and setting an average gap between the two bodies within the range of 0.1 mm to 300 mm.

10. The method of claim 9, further comprising the step (B') of adjusting the degree of vacuum in the processing chamber within the range of $1\times10^{-5}$ Pa to 1 Pa after the temperature of the atmosphere in the processing chamber has decreased to 950° C. or less and after the step (B) has been performed.

11. The method of claim 9, further comprising the step (B") of performing a heat treatment process for 30 minutes to 300 minutes with the degree of vacuum in the processing chamber adjusted within the range of $1\times10^{-5}$ Pa to 1 Pa and the temperature of the atmosphere in the processing chamber controlled within the range of 1,000° C. to 1,200° C. and then lowering the temperature in the processing chamber to 950° C. or less after the step (B) has been performed.

* * * * *